US005221944A

United States Patent [19]

Yoda et al.

[11] Patent Number: 5,221,944

[45] Date of Patent: Jun. 22, 1993

[54] LIQUID ELECTROPHOTOGRAPHIC METHOD AND AN APPARATUS THEREFOR

[75] Inventors: Akira Yoda; Takao Ozaki; Yoshimitsu Sato; Hisao Oh-ishi; Keijirou Kaite, all of Kanagawa, Japan

[73] Assignee: Fuji Photo Film Co., Ltd., Kanagawa, Japan

[21] Appl. No.: 683,601

[22] Filed: Apr. 10, 1991

[30] Foreign Application Priority Data

| | | | |
|---|---|---|---|
| Apr. 16, 1990 | [JP] | Japan | 2-99651 |
| Apr. 17, 1990 | [JP] | Japan | 2-101201 |
| Apr. 17, 1990 | [JP] | Japan | 2-101202 |
| Apr. 17, 1990 | [JP] | Japan | 2-101203 |
| Apr. 18, 1990 | [JP] | Japan | 2-102556 |
| Apr. 19, 1990 | [JP] | Japan | 2-103900 |

[51] Int. Cl.[5] ..... G03G 15/10

[52] U.S. Cl. ..... 355/256; 118/645; 118/659; 355/326; 355/327

[58] Field of Search ..... 355/208, 245, 246, 256, 355/303, 305, 307, 326, 327; 118/645, 659, 660; 430/42, 117

[56] References Cited

U.S. PATENT DOCUMENTS

| | | | |
|---|---|---|---|
| 3,725,059 | 4/1973 | Komp | 355/307 X |
| 3,741,643 | 6/1973 | Smith et al. | 355/256 |
| 4,522,484 | 6/1985 | Landa | 355/256 |
| 4,660,503 | 4/1987 | Jones | 118/645 |
| 4,962,407 | 10/1990 | Ueda | 355/246 X |
| 5,025,292 | 6/1991 | Steele | 355/256 X |
| 5,053,823 | 10/1991 | Oh-ishi et al. | 118/660 X |

FOREIGN PATENT DOCUMENTS

| | | | |
|---|---|---|---|
| 89122260 | 12/1989 | European Pat. Off. | 355/307 |

*Primary Examiner*—A. T. Grimley
*Assistant Examiner*—J. E. Barlow, Jr.
*Attorney, Agent, or Firm*—Sughrue, Mion, Zinn, Macpeak & Seas

[57] ABSTRACT

In a liquid electrophotographic method, in which while a photoconductive drum is rotating a plurality of toners are deposited thereon to thereby transfer an image simultaneously onto a transfer material, at a first rotation of the drum, each color toner image is formed onto the drum and the drum is dried during a second rotation thereof. Consequently, the image information can be transferred utilizing the time taken to dry the drum. In addition, in the same apparatus, an electric charging unit, an exposure unit, a developing unit, a drying unit, a transfer unit and the like are disposed along the outer circumference of the drum. Consequently, the entire apparatus can be compactly arranged.

11 Claims, 29 Drawing Sheets

FIG. 5A
FIRST COLOR
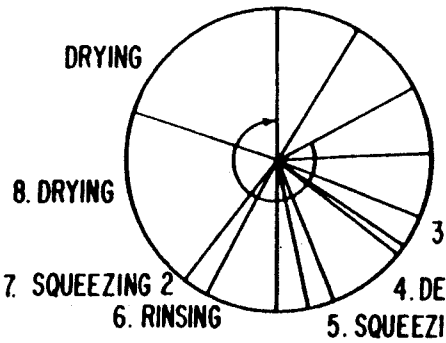
FIG. 5B
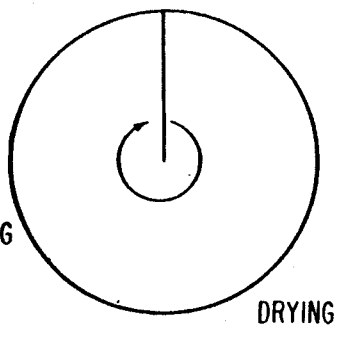
FIG. 5C
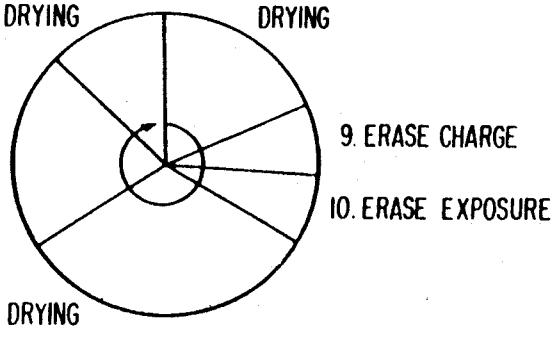
FIG. 5D
SECOND TO THIRD COLORS
FIG. 5E
FIG. 5F

THE LAST COLOR

CLEANING MODE

PROCESS SEQUENCE
THIRD ROTATION DURING TRANSFERRING

LIQUID ELECTROPHOTOGRAPHIC METHOD AND AN APPARATUS THEREFOR

BACKGROUND OF THE INVENTION (a) Field of the Invention

The present invention relates to a liquid electrophotographic apparatus for forming a toner image on a photoconductive drum using a developing solution while transferring the formed toner image onto a transfer material, and more particularly to the electrophotographic apparatus suitable for a color proofing.

(b) Description of the Related Art

As a system for forming a colored toner image, there is one known in which four color toner images are formed on a photoconductive material for each color in accordance with the electrophotographic manner to sequentially overlap those toner images on a transfer sheet.

There is another system in which a four color toner image is formed on a transparent disposable photoconductive material to transfer it for each of those colors. Besides, there is also one in which a plurality of toner images are respectively overlapped on the photoconductive drum by dry development so as to transfer these toner images onto a transfer sheet.

Further, as a high quality laser printer adapted for forming a proof, there is one in which a plurality of toner images are respectively overlapped on a photoconductive drum made of an organic photocopier material, which is sensitive to the infrared region, in accordance with the liquid developing method, to transfer these toner images onto a transfer sheet.

However, according to the above-described system, in which the four color toner images are respectively sequentially overlapped onto the transfer sheet, since the transfer sheet is elongated during the transfer operation, it is difficult to obtain the registration of each color image (registration).

In addition, according to the system using the transparent disposable photoconductive material, each time the images are transferred, a new photoconductive material must be used resulting in a relatively expensive system.

Further, in the system using the dry-type development, because of the large size toner particles, it is difficult to obtain a high resolution (2000 dot/inch or above) color toner image which may be adapted for to proofing obtain a satisfactory proof.

Still further, in a system using a photoconductive drum formed of the above-described organic photoconductive material, since the material is likely to deteriorate due to the presence of a carrier solution (isoparaffin series solvent) of the developing solution, it cannot be used many times. Finally, there has been a problem in achieving a relatively short transfer time of the image information.

In view of the above-described circumstances, an object of the present invention is to allow the drum-shaped photoconductive material to be repeatedly used while obtaining a high quality color toner image.

SUMMARY OF THE INVENTION

A liquid electrophotographic method according to the present invention, in which, while a drum-shaped photoconductive material is rotating, a plurality of toners is deposited on the above-described photoconductive material and transferred at one time comprising steps of:

(a) rotating the photoconductive material once to at least electrically charge, expose and develop the same with a developing solution which contains the toner and carrier solution;

(b) rotating the photoconductive material a second time to at least dry the photoconductive material;

(c) rotating the photoconductive material a third time to at least remove the charges therefrom;

(d) repeating the above-described steps (a) through (c) at least a plurality of times; and (e) transferring the plural toners deposited on the photoconductive material onto a transfer material at one time and cleaning the photoconductive material a first time.

As described above, according to the liquid electrophotographic method of the invention, when the photoconductive material is rotated a first time, it is at least electrically charged, exposed and developed by the developing solution. When rotated a second time at least one color toner image is dried. When rotated a third time, the electric charge is removed. When the above-described sequence of steps is repeated the same number of times as the number of toner colors and all the color toners have been deposited onto the photoconductive material, an en masse transfer onto the transfer material is now performed. When this transfer has been completed, the photoconductive material is cleaned so as to be made ready for the next operation.

In addition, since the drying cycle is performed during the second rotation of the photoconductive material, toner image information can be transferred utilizing the process time including this drying cycle in the event that there is a need to rapidly write data so that a data transfer speed that is enough to write the data can be secured.

The liquid electrophotographic apparatus according to the present invention comprises:

a drum-shaped photoconductive material axially rotating in a predetermined direction, the photoconductive material being sensitive to light within a specific wavelength region and unlikely to deteriorate even under the action of a developing solution containing toner particles and a carrier solution and having a small absorption factor for the light lying within the above-described specific wavelength region;

an electrical charging means for charging the above-described photoconductive material;

an exposure means for illuminating the light within the above-described specific wavelength region on the electrically charged material to form an electrostatic latent image on the material;

a developing means for developing the electrostatic latent image utilizing the above-stated developing solution to sequentially form a plurality of color toner images on the photoconductive material in a deposited manner;

a drying means for drying the toner images each time they are formed on the photoconductive material by the developing means;

a means for removing the electric charges from the photoconductive material each time, except for the last one formed, the toner images have been dried with the drying means;

a transfer means for transferring en masse the plurality of color toner images formed on the photoconductive material onto the transfer material; and a first cleaning means for removing the toner particles remaining on the surface of the photoconductive material after completion of the transfer through the above-described transfer means.

In the liquid electrophotographic apparatus thus arranged, since the photoconductive material does not easily deteriorate under the action of the developing solution, the photoconductive material can be repeatedly used.

In the present invention, since the toner images are deposited onto the photoconductive material that does not deteriorate with the developing solution, to transfer onto the transfer material, despite repeated transfer operations the photoconductive material can be maintained in an excellent condition. As a result, a plurality of toner images, which can excellently reproduce its tone and density, can be transferred onto the transfer paper.

In addition, since the plurality of toner images, deposited on the photoconductive material, is transferred en masse onto the transfer material, a definite toner image, which is free from color drift, can be transferred onto the transfer material.

Still further, since the charging means, exposure means, developing means, drying means and transfer means or the like can be disposed along the outer circumference of the drum-shaped photoconductive material, it is possible to make the apparatus compact.

BRIEF DESCRIPTION OF THE DRAWINGS

Some specific embodiments of the invention are now hereinafter described with reference to the accompanying drawings in which;

FIG. 5A through 5J are respectively an explanatory view of the operation of the liquid electrophotographic apparatus;

DETAILED DESCRIPTION OF THE PREFERRED EMBODIMENTS

Figure 1:
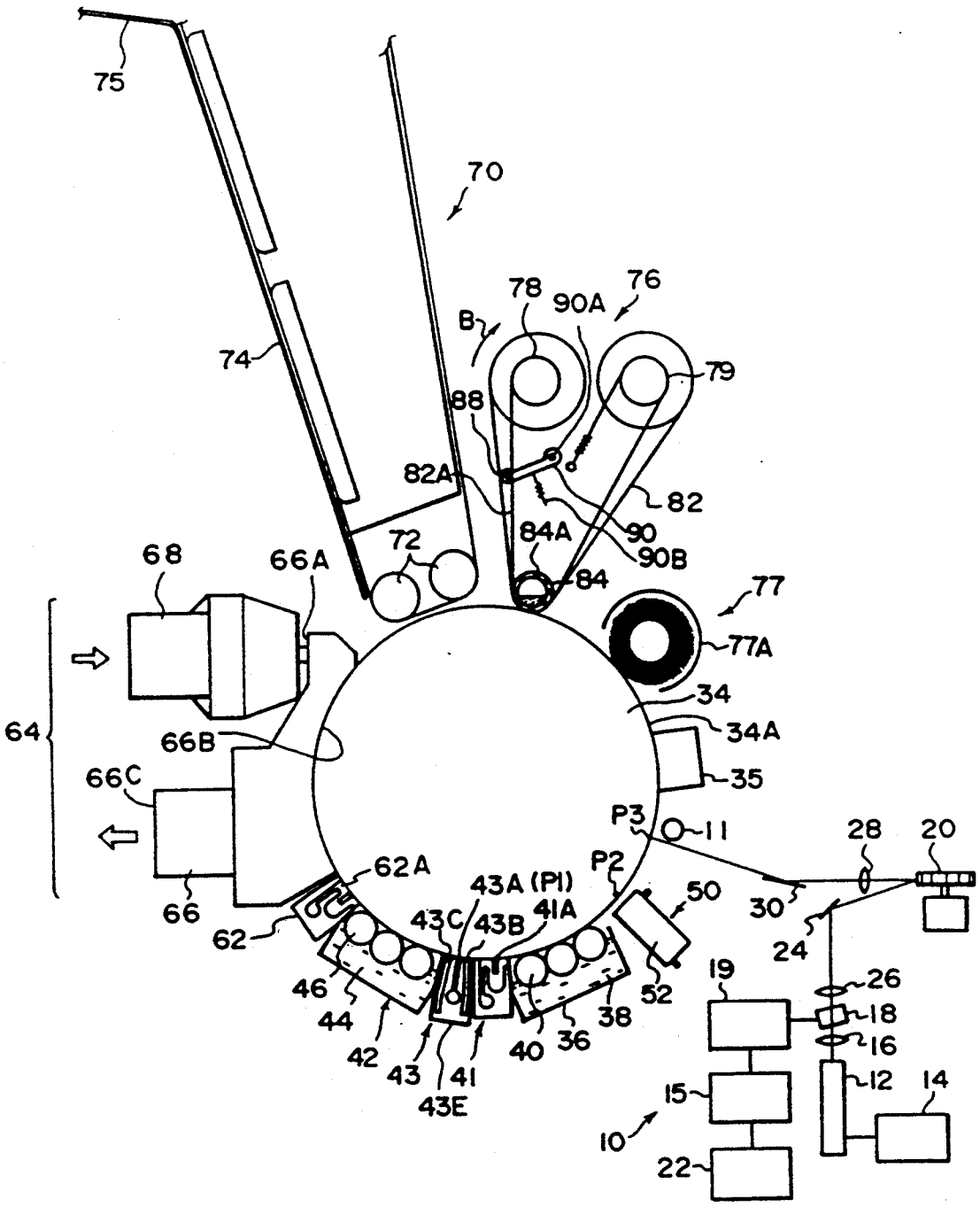
FIG. 1 is a layout view of each processing portion which forms a liquid electrophotographic apparatus according to a first embodiment of the present invention.

FIG. 1 illustrates a layout view of the processor portions each constituting the liquid electrophotographic apparatus according to a first embodiment of the invention.

An exposure portion 10, which forms part of the apparatus, comprises a semiconductor laser 12 for oscillating a laser beam lying within the infrared region (for example, 800 nm), a control portion 14 for controlling the output condition of this semiconductor laser 12, condenser lenses 16, 26, a scanner lens 28, reflecting mirrors 24, 30, a multi AOM (acoustic optical modulator) 18 for driving the incident laser beam into a plurality of different directions in accordance with an incident ultrasonic frequency, a driver 19 for driving the multi AOM 18, a polygonal mirror (hereinafter referred to as "polygon mirror") 20 and a memory 15 for storing image information supplied from a host computer 22. The image information for a single screen size (for example, monochromatic toner image) is stored within this memory 15.

The laser beam lying within the infrared region, which is emitted from the semiconductor laser 12, illuminates the multi AOM 18 via the condenser lens 16. In addition, a different ultrasonic frequency, which is generated depending on the image information stored within the memory 15, is supplied to the multi AOM 18 via the driver 19. As a result, the laser beam is diffracted in a different direction corresponding to the ultrasonic frequency while the light intensity is modulated according to the image information. The modulated laser beam is condensed by the condenser lens 26 and further is incident onto the polygon mirror 20, which rotates at a fast speed, via the reflecting mirror 24. The laser beam reflected against the polygon mirror 20 is illuminated onto the image forming region on a photoconductive drum 34 via the scanner lens 24 on the reflecting mirror 30 with the result that the laser beam, which is modulated according to the above-described image information, is scanned on a photoconductive material 34A. In this embodiment, since the multi AOM 18 is used, a plurality (for example, 8) of laser beams is simultaneously scanned. The above-described photoconductive drum 34 is connected to a driver means (not shown) and is rotated in the clockwise direction, as viewed in FIG. 1, by this driver means. Provided on the outer surface of the aluminum photoconductive drum 34 is a photoconductive material 34A made of amorphous silicon. Although this amorphous silicon suffers from rapid dark decay, it is sensitive to light lying within the infrared region (for example, 800 nm), yet exhibits a high durability relative to the liquid developing agent, which allows repeated use and is suitable for this embodiment.

The outer diameter of the photoconductive material 34A is defined to be 210 mm. In addition, as shown in Table 1, the circumferential speed of the material 34A is defined to be 50 mm/sec. In view of the dark decay characteristic (time constant of the dark decay is approximately 10 sec.) of the above-described amorphous silicon, it is desirable to set the time from after electrical charging (described later) until completion of squeezing immediately after development (that is, until the extra liquid developing agent remaining on the photoconductive material 34A is eliminated from the photoconductive material) to be below 5 sec. In this embodiment, in order to meet this condition, time from the start of electrical charging until completion of development is set to 3.9 sec.

A write specification relative to the photoconductive material 34A is shown below in Table 1.

TABLE 1

| parameters | this embodiment | compared example |
|---|---|---|
| recording dot density (Dot/inch) | 2000 | 400 |
| circumferential speed (mm/sec) | 50 | 156 |
| screen size | A3 | A3 |
| recording speed (Dot/sec) | $93 \times 10^6$ | $11.6 \times 10^6$ |
| photosensitivity ($\mu J/cm^2$) | 8.0 (at 800 nm) | |
| necessary intensity of light to be applied onto the photoconductive material ($\mu W$) | 1200 (at 800 nm) | |

Incidentally, the compared example is relevant to the data on a general purpose OA laser printer.

A corona charger 35 is disposed upstream from the photoconductive material 34A, as viewed in the rotating direction thereof, where the laser beam lying in the infrared region becomes incident. This corona charger 35 is provided with a corona wire and a grid wire and is connected to AC and DC power supplies via a switch (not shown). Prior to forming a latent image, after the surface of the photoconductive material 34A is uniformly charged to the positive or negative potential by the corona charger 35, a laser beam modulated according to a copy image becomes incident onto the surface of the photoconductive material 34A. A portion of the material 34A where the laser beam is incident is turned electrically conductive and the electric charges, which has been loaded on its surface, disappear to form an electrostatic image on the surface of the photoconductive material 34A.

Further, as will be described later, the corona charger 35 is connected to a DC power supply so that the resulting DC corona discharge may apply a charge of the same polarity as the toner to strengthen (precharge) the toner charge.

Still further, as will be described later, the corona charger 35 is connected to an AC power supply to cause an AC corona discharge so that the electric charges existing on the photoconductive material 34A may be neutralized to remove the remaining potential on the photoconductive material 34A.

As shown in FIG. 1, downstream of the corona charger 35 (as viewed in the rotating direction of the photoconductive drum 34) a halogen lamp 11 extending in the axial direction of the photoconductive drum 34 is disposed. A yellow filter (not shown), for example, is interposed between the light emitting surface of the halogen lamp 11 and the photoconductive drum 34. The electric charges on the photoconductive material 34A can be neutralized by illuminating the light emitted from this halogen lamp 11 onto the photoconductive material 34A through a filter. This removal of electricity with optical means can display the same function as the preceding removal of the same and is conducted for increasing the neutralization of the charges on the photoconductive material 34A, as will be described later.

In addition, the light of the above-described halogen lamp 11 can be used, as will be described later, to previously expose the photoconductive material 34A to increase the transfer efficiency of the toner applied thereon.

As shown in FIG. 1, a prewetting unit (hereinafter referred to as a "prewet unit") 50 is provided downstream of the position where the laser beam comes incident onto the photoconductive material 34A (as viewed in the rotating direction of the photoconductive drum 34 relative to the incident position). The distance (circumferential length) between a position P2 and the position P3 on the photoconductive material 34A, which lies opposed to the prewet unit 50, is set to be about 50 mm.

Figure 2:
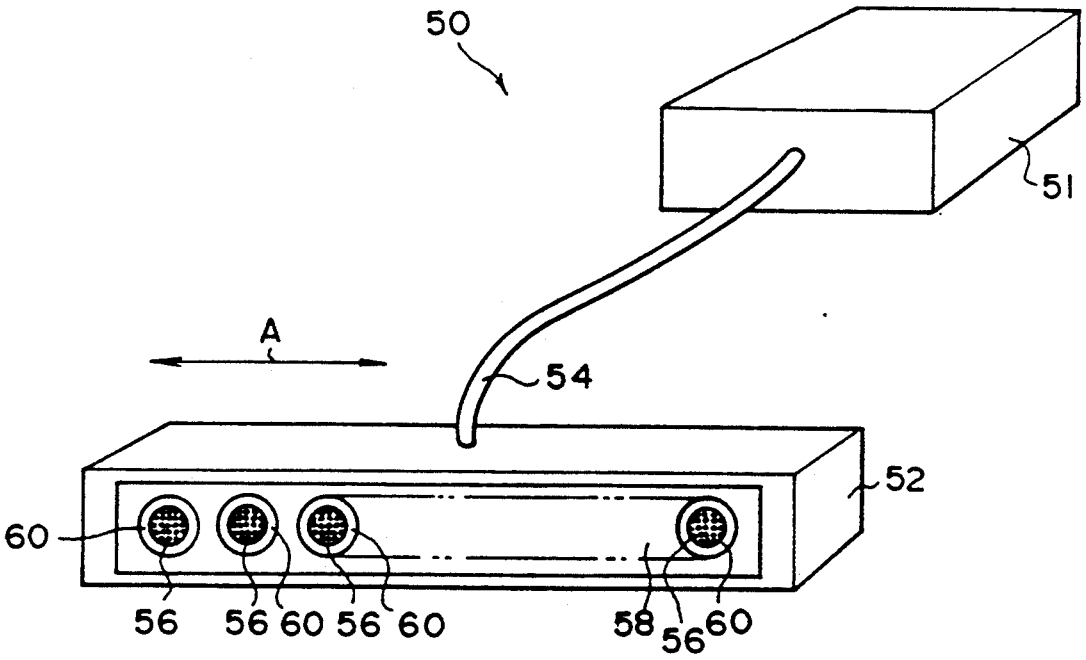
FIG. 2 is a perspective view of a prewetting unit.

The prewet unit 50 is provided with a chamber 52 into which a carrier solution flows. As shown in FIG. 2, the chamber 52 is of rectangular parallelopiped form, the length of which (as viewed in the direction of arrow A of FIG. 2A) is mounted so as to run in the axial direction of the photoconductive drum 34. The chamber 52 is coupled to a means 51 for feeding the carrier solution via a line 54. The carrier solution may be supplied into the chamber 52 by this means 51.

Figure 3A:
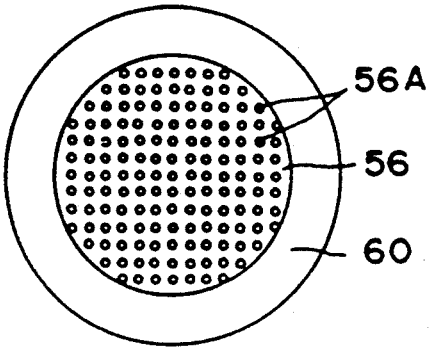
FIG. 3A and 3B are respectively an enlarged view of a fountain portion of a porous sheet.
Figure 3B:
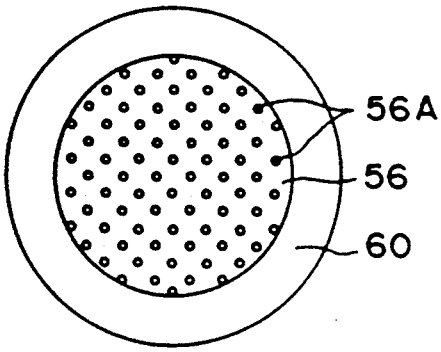

A rectangular porous plate 58 is disposed on the surface of the chamber 52 opposed to the surface of the photoconductive drum 34, with its longitudinal direction running in the axial direction of the drum 34. A plurality of substantially circular spray portions 56 are provided at this porous sheet 34 at intervals in the axial direction of the drum 34. Formed at each of these spray portions 56 are a plurality of small holes 56A. As shown in FIG. 3A, these small holes 56A are perforated at equal intervals in the vertical as well as transverse direction thereof. Incidentally, these small holes may be arranged in a staggered manner, as shown in FIG. 3B.

An annular ultrasonic vibrator 60 is mounted at the outer periphery of each of the above-described spray portions 56 and the plurality of small holes 56A lie inside the inner circumference of this vibrator 60. Incidentally, although not shown, a voltage applying means is connected to the ultrasonic vibrator 60 so that by adjusting the frequency and magnitude of the voltage applied to the vibrator 60, the amplitude and cycle of the vibration applied to the porous plate 58 may be controlled.

Figure 9:
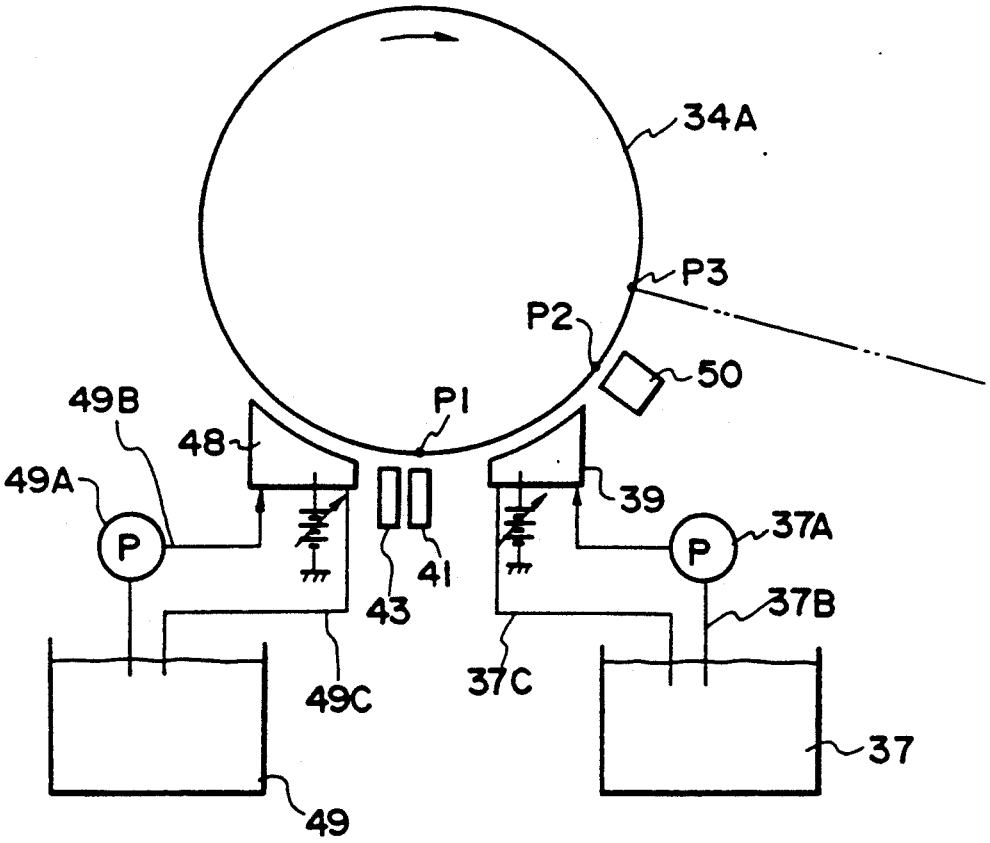
FIG. 9 is a layout view of each processing unit disposed around the lowermost portion of the photoconductive drum.

Disposed downstream of the prewet unit 50 (as viewed in the rotating direction of the photoconductive drum 34 of FIG. 1) is a developing agent unit 36, which has a box, the top of which is open, and a liquid developing agent 38 is stored therein. This liquid developing agent 38 is sucked from a developing tank 37 (see FIG. 9) storing the liquid developing agent by means of a pump 37A to be introduced into the box via a line 37B. In addition, an extra developing agent supplied to the photoconductive material 34A is recovered to a developing tank through a line 37. This liquid developing agent 38 is available with each color of the toner particles comprising four colors (e.g., black, yellow, magenta and cyan). With the toner particles of this developing agent 38, its absorption factor for the light lying in the infrared region is made small. For this developing agent, any well known one may be used such as ones disclosed in Japanese Patent Application Publication Nos. 35-5511, 35-13424, 50-40017, 49-98634, 58-129438, Japanese Patent Application Laid-Open No. 61-180248 and in "Fundamentals of the Electrophotographic Technique and its Application" (edited by Association of the Electrophotographic Science, issued 1988 by Corona Inc.) and the like.

In general, these liquid developing agents each comprises a carrier solution, a colorant for forming the toner particles, a coating agent made of a high molecule resin to apply a fixability of the colorant, a dispersing agent for promoting dispersion of the toner particles or for serving to stabilize the dispersion and an electric charge adjusting agent for controlling the polarity of the toner particles and the amount of their charges.

As the coating agent, various known resins may be used, but as disclosed in Japanese Patent Application Laid-Open Nos. 61-180248, 63-41272 and 63-41273, the ethylene series copolymers formed by reacting ethylene and (metha) acryl acid, ethylene and vinyl acetate copolymer of the ethylene and ethylacrylate, copolymer of the ethylene and ester (metha) acrylate, or a terpolymer of ethylene, (metha) acryl acid and ester (metha) acrylate are preferably used. The toner particle within the developing agent is not particularly restricted, but may be 0.1 to 200 g/l per liter of the developing agent. That is, 5 to 10000 cc of the carrier solution per gram of the toner particles.

As the charge adjusting agent, various known agents may be used and their density by weight is 0.01 to 10 g per liter of the developing agent and preferably 0.01 to 1 g. Again, various known dispersing agents may also be used and their density by weight is 0.01 to 50 g per liter of the developing agents and preferably 0.1 to 10 g.

At the above-described developing agent unit 36, a plurality of electroconductive developing rollers 40 are disposed so as to correspond in position to the image forming area of the photoconductive material 34A and extend in the axial direction of the photoconductive drum 34. Part of the outer surface of these developing rollers is immersed in the liquid developing agent 38. A positive voltage is applied to the developing rollers 40 so that blushing may be prevented as occurs by the toner adhering to the background of the image. These rollers 40 are driven for rotation by means of a mechanism (not shown). In addition, the rollers 40 are shifted from a position from which they move away to a position where they abut the same by means of a mechanism (not shown) (see FIG. 1) so that the liquid developing agent 38 may be applied to the image forming area via the developing rollers 40. Further, the developing rollers 40 are shifted to turn from the above-described abutting state to a state in which they move away from the image forming area, so that by altering the type of the developing agent unit 36, four types of color can be applied.

Disposed downstream of the developing agent unit 36 as viewed in the rotating direction of the photoconductive drum 34 is a first squeezing unit 41 having an air injection portion 41A extending in the axial direction of the drum 34 and opposed to the image forming area. The excess liquid developing agent 38 supplied to the image forming area is introduced from the image forming area to a developing agent tank 37 by the air ejected from this air ejecting portion 41A with the result that it can be recycled. As indicated by arrows 53 of FIGS. 11A through 11C, the above-described air is preferably ejected toward the unit 36 rather than in the vertical direction.

Disposed downstream of the first squeezing unit 41 as viewed in the rotating direction of the drum 34 is a rinsing solution unit 42, which is provided with a box, the top of which is opened. This box stores the rinsing solution 44. This solution 44 is sucked from a rinsing solution tank 49 (see FIG. 9), in which the rinsing solution is stored, by means of a pump 49A and introduced into the above-described box through a line 49B. In addition, an excess amount of rinsing solution, which is supplied to the photoconductive material 34A, is recovered to the tank 49 via a line 49C. As this rinsing solution 44, a non-polar, non-aqueous solvent, which is above $1\times10^9$ Ω·cm in electric resistance and below 3 in specific permissivity may be used. As a non-aqueous solvent, a straight chain or branched aliphatic hydrocarbon, alicyclic hydrocarbon, aromatic hydrocarbon, halogenated hydrocarbon or the like may be mentioned, but from the point of volatility, safety, odor and the like, Isopers E, G, H and L (Isoper is a trademark possessed by Exxon Inc.), or solvesso 100 or shellzole 71 (commercially available from Shell Inc.), which are each octane, isooctane, decane, isodecane, dodecane, isododecane, nanone, isoparaffin, or isoparaffin series petroleum solvent, are preferred.

At the rinsing solution unit 42, a plurality of electroconductive rinsing rollers 46 are disposed opposed to the image forming area and extending in the axial direction of the photoconductive drum 34. Part of the outer surface of these rinse rollers 46 is immersed in the rinse solution 44. A positive voltage on the same order as that applied to the above-described rollers 40 is applied to the rinse rollers 46 or connected to ground or is insulated. Thus the toner is prevented form adhering to the background portion of the image, that is blushing can be eliminated. The rinse rollers 46 are shifted from the position from which they move away to the position of FIG. 1 where they abut the image forming area by means of a mechanism (not shown) so that the rinse solution 44 may be applied to the image forming area via the rinse rollers 46.

Further, the rinse rollers 46 are arranged to abut the image forming area as it is being developed and move away therefrom.

Figure 10:
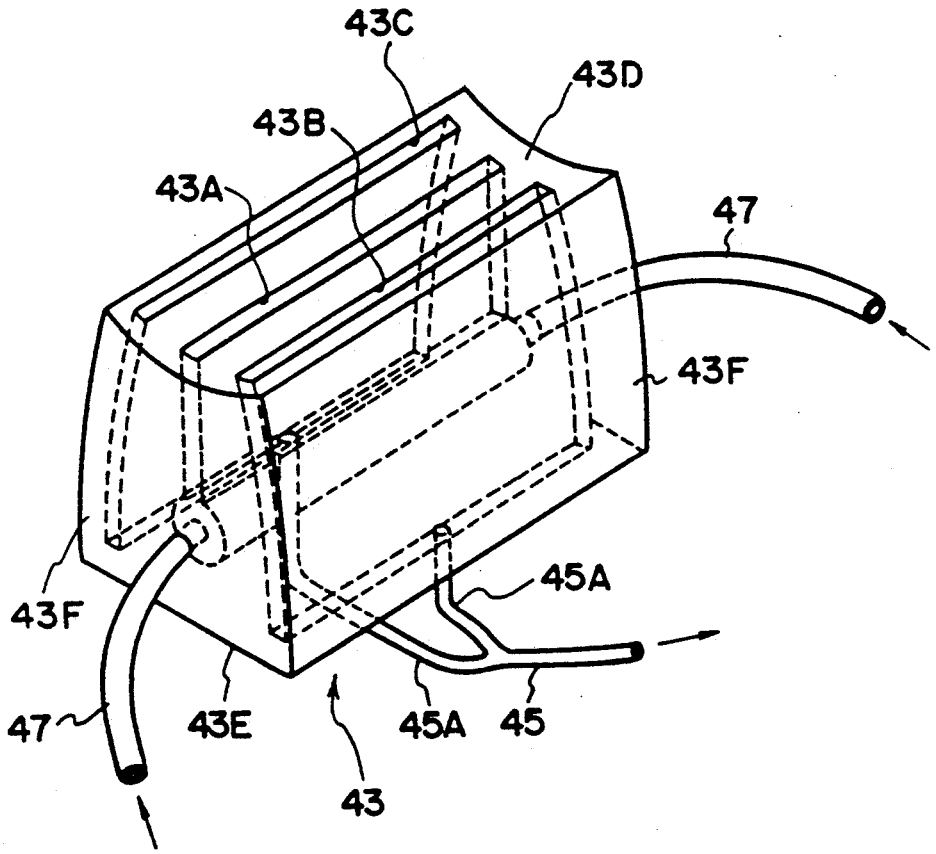
FIG. 10 is a perspective view of a squeeze unit 43.

A second squeeze unit 43 which extends in the axial direction of the photoconductive drum 34 is disposed between the first squeeze unit 41 and the rinse solution unit 42, the squeeze unit 43 serving as a means for blowing air. As shown in FIG. 1, the squeeze unit 43 of FIG. 10 is disposed slightly nearer to the rinse solution unit than to the lowermost portion of the outer periphery of the photoconductive material 34A. This is because the first squeeze unit 41 is disposed at the lowermost portion of the outer surface of the material 34A in order to recover most ideally the developing agent. A distance (circumferential length) between the position P1 opposed to the second squeeze unit 43 and the above-described position P2, which lie on the photoconductive material 34A, is set to be about 80 mm.

As shown in FIGS. 1 and 10, the second squeeze unit 43 is formed into an angular column so that as cut away in its crosswise direction its cross section may present a trapezoidal form. The opposed surface 43D of the second squeeze unit 43 which faces the photoconductive material 34A is formed to exhibit a curved surface of substantially the same curvature as that of the photoconductive material 34A. At the squeeze unit 43, an air ejecting portion 43A having the opposed surface 43D as the opening portion is formed and a line for delivering the liquid developing agent 43B and a line for delivering the rinse solution are formed with this portion 43C between. The delivery lines 43B and 43C are also each opened at their opposed surface 43D. These opening portions each extend in the axial direction of the photoconductive drum 34 facing the above-described image forming area. Incidentally, the gap between the opening portions of the air ejecting portion 43A is set to be about 2 to 3 mm while the one between the opening portions of the lines 43B and 43C is set to be about 1 mm.

Figure 11A:
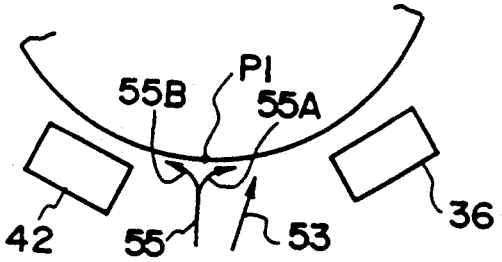
FIG. 11A through 11C are respectively a schematic view of air blown around the lowermost portion of the photoconductive drum by means of the squeeze units 41 and 43.

As shown in FIG. 10, one end of the line 47 communicates with the end surfaces 43F at both ends of the air ejecting portion 43A. The other end of the line 47 is coupled to an air pressurizing means (not shown), by means of which air is blown to the neighborhood of the position P1 (at the lowermost portion of the above-described outer surface) so that the air ejected from the air ejecting portion 43A is blown to the excessive developing agent and rinse solution, which are adhering around the position P1. As shown in FIG. 11A, air 55 blown to the neighborhood of the position P1 is divided into the upstream portion (indicated by arrow 55A) and the downward portion (indicated by arrow 55B) as viewed in the rotating direction of the photoconductive material 34A, with the position P1 as its axis. The developing agent is predominantly removed from the surface of the material 34A by means of air indicated by arrow 55A while the rinse solution is predominantly removed from the surface of the material 34A by air indicated by arrow 55B.

Figure 11B:
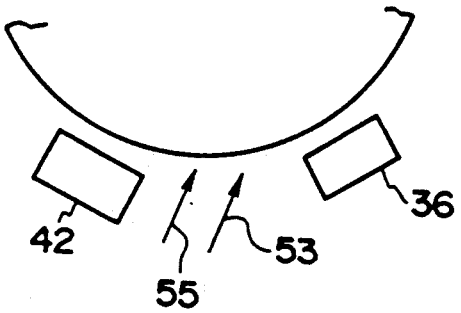
Figure 11C:
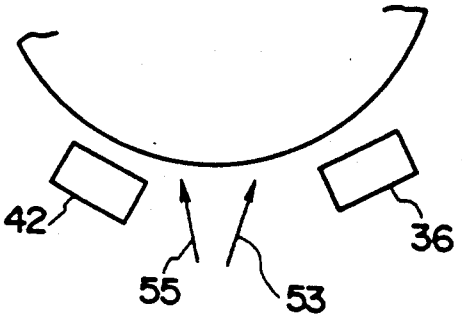

Incidentally, as shown in FIG. 11B, air 55 may also be ejected inclined toward the developing unit 36. Or as shown in FIG. 11C, it may be ejected inclined toward the rinse solution unit 42.

At the delivery lines 43B and 43C, lines 45A formed with one end of the line 45 bifurcated each communicate with each other at the lower surface corresponding to the opposed surface 43D. The other end of the line 45A is coupled to a waste solution tank (not shown). As a result, the developing agent and rinse solution flowing into each of the delivery lines 43B and 43C are introduced into the waste solution tank.

Disposed downstream of the rinse solution unit 42 (as viewed in the rotating direction of the photoconductive drum 34) is a third squeeze unit 62 having an air ejecting portion 62A, which extends in the axial direction of the drum 34 to oppose the image forming area. The rinse solution supplied to the image forming area is excluded from the image forming area by the air ejected out of this air ejecting portion 62A to be introduced to a waste solution tank (not shown).

Disposed downstream of the third squeeze unit 62 (as viewed in the rotating direction of the photoconductive drum 34) is an evacuating duct 66, which forms part of a drying portion 64. This evacuating duct 66 is arranged so that its side facing the photoconductive material 34A forms an arcuate opening portion 66B so as to have substantially the same radius of curvature as that of the photoconductive material 34A.

In addition, disposed downstream of this evacuating duct 66 as viewed in the rotating direction of the drum is a suction chamber 68, which forms the drying portion 64 together with the evacuating duct 66.

The opposite side of this suction chamber 68 relative to the photoconductive drum 34 is coupled to a blower (not shown) while its side facing the drum 34 is opposed to an opening portion 66A for introducing the air, which lies downstream of the evacuating duct 66. Air fed from this opening portion 66A passes through the opening portion 66B to be blown toward the material 34A so that the wet material 34A is dried. Air fed to the photoconductive material 34A is delivered to the outside of the liquid electrophotographic apparatus via an air delivery port 66C.

Disposed downstream of the above-described suction chamber 68 (as viewed in the rotating direction of the photoconductive drum 34) is a transfer unit (hereinafter referred to as a "transfer portion") 70, which is shifted in the direction close to or leaving from the outer circumference of the photoconductive material 34A by means of a drive means (not shown). At the transfer portion 70, a pair of transfer rollers 72 which extend in the axial direction of the drum 34 are provided close to the photoconductive material 34A. At the upper portion of these transfer rollers 72, a guide 74 which extends in the direction leaving from the drum 34 is disposed. Coupled to the transfer guide 74 is a tray 75 for storing the transfer material and the transfer material placed in the tray 75, guided by the transfer guide 74, reaches a position where it is pinched by the transfer rollers 72 and photoconductive material 34A to be transferred.

Disposed downstream of the above-described transfer portion, as viewed in the rotating direction of the photoconductive drum 34 is a cleaning unit (second cleaning means) 76, downstream of which, as viewed in the rotating direction of the photosensitive drum 34, a cleaning brush 77 is disposed. At the above-mentioned cleaning means 76, a take-up roller and a web roller 79 are provided. The take-up roller 78 is rotated in the same direction as the drum 34, as viewed in the direction of B of FIG. 1) by means of a take-up motor 86 (see FIG. 7). In addition, the take-up roller 78 and web roller 79 are each shaped into a cylinder made of hard polyvinyl chloride, the axial direction of which is oriented toward that of the photoconductive material 34. The take-up roller 78 and web roller 79 are removably designed.

A cleaning web 82 formed with a non-woven fabric or the like is wound about the take-up roller 78 and web roller 79. The length of the cleaning web 82 as viewed in the crosswise direction thereof is set to be the same as that of the photoconductive drum 34 as viewed in the axial direction thereof. Thus, cleaning over the entire outer circumference of the photoconductive material 34A is achieved by the cleaning portion 76.

Figure 8:
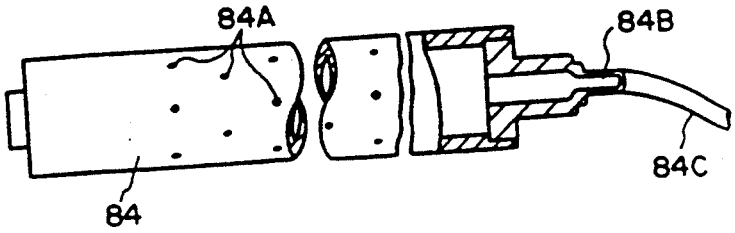
FIG. 8 is a partial cross-sectional view of a cleaning roller.

In addition, at the cleaning portion 76, a cleaning roller 84 having a plurality of through holes 84A perforated is provided so as to extend in the axial direction of the photoconductive drum 34. As shown in FIG. 8, the through holes 84A are disposed in staggered manner along the cylindrical surface of the cleaning roller 84. The cleaning roller 84 is formed into a cylinder made of aluminum and is disposed with its axial direction running in the axial direction of the photoconductive material 34. As shown in FIG. 8, at the substantially central portion of the lateral surface of the cleaning roller 84, a port 84B for pouring the carrier solution is provided to protrude and a tube 84C for supplying the carrier solution is connected thereto. Within this cleaning roller 84, a carrier solution such as the above-described isoper G, which is poured from this port 84, is stored. This cleaning roller 84 is wound about the intermediate portion of the cleaning web 82. The cleaning roller 84 is opposed to the above-described image forming area via this web 82. The cleaning portion 76 is shifted in the abutting and moving away directions relative to the outer surface of the photoconductive material 34A by means of a driving means (not shown).

In addition, as shown in FIG. 1, a tension roller 88 is disposed at the cleaning portion of the photoconductive material 34A. The tension roller 88 is coupled to an arm 90 which swivels with a fulcrum 90A as its axis. In addition, the tension roller 88 is urged in the direction that presses the cleaning web 82A on the take-up side by means of a spring member 90B mounted to the arm 90 so that a tensile force may be applied to the cleaning web 82A on the take-up side. Thus, sagging of the cleaning web 82A can be prevented during the cleaning process.

The cleaning brush 77 is formed by embedding a multiplicity of rayon or soft bristles along the columnar surface of the cylinder and extends in the axial direction of the photoconductive drum 34 and abuts and moves away from the outer surface of the photoconductive material 34A by means of a driving means (not shown). In addition, the cleaning brush 77 is rotated at a fast speed by means of a motor (not shown), which may be a variable speed DC motor. In this case, the r.p.ms are set within a range of about 100 to 5000 rpm. Incidentally, the outer diameter of the cleaning brush 77 is set to about 60 mm and the axial length of the cleaning brush 77 to about 340 mm. Further, the length of the soft bristles is set to about 15 mm while the thickness is set to below approximately 5 denir.

Figure 7:
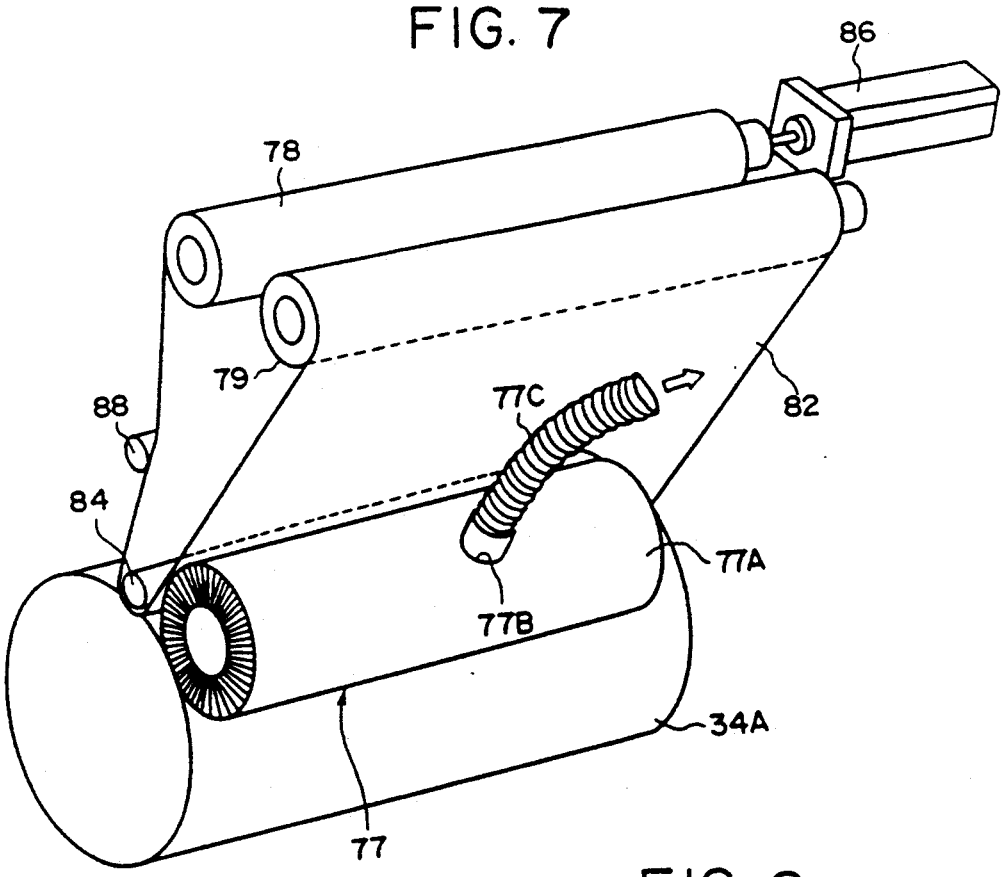
FIG. 7 is a perspective view of a cleaning member according to the first embodiment of the present invention.

As described above, when the length and thickness and the like of the soft bristles are properly set, a blurring of the image, which can occur as the cleaning brush 77 is cleaning, can be completely prevented. As shown in FIGS. 1 and 7, the opposite side of the cleaning brush 77 relative to the photoconductive drum 34 is covered with a substantially C-shaped cover 77A which is open towards the photoconductive drum 34. Further, at a substantially central portion of the cover 77A substantially circular hole 77B is provided so that one end of a suction tube 77C is coupled to a suction means such as a domestic vacuum cleaning or the like (not shown). As a result, air within the columnar body of the cleaning brush 77 may be delivered to the outside environment. In the cleaning process, which will be described later, the cleaning brush 77 slides along the surface of the photoconductive material 34A to remove foreign matter adhering thereto without blurring the toner image formed on the photoconductive material 34A.

The operation of this embodiment is hereinafter described. In this embodiment, one cycle is completed with three rotations of the photosensitive drum 34, that is, after a black image is formed at a first cycle, a yellow image is formed at a second cycle so as to overlap the black image, a magenta image at a third cycle and a cyan image at a fourth cycle. In addition, at a first rotation of one cycle, treatment is conducted including electric charge, exposure, developing and part of a drying operation. A part of the drying operation is performed at the second rotation. In addition, treatment including the removal of electricity and cleaning are performed at the first time rotation. In addition, the rest of the drying operation is performed at the third time rotation, so that the drying of the first color toner image formed on the photoconductive material 34A is completed and the formation of the second color toner image becomes possible. Incidentally, in this embodiment, a developing agent including the negatively charged toner particles is used. First, a description is made concerning the first cycle, in which a black image is formed on the photoconductive material 34A. Image information about an image to be copied is sequentially supplied from a host computer 22 to a memory 15, where a single image (black image) is stored.

Figure 5G:
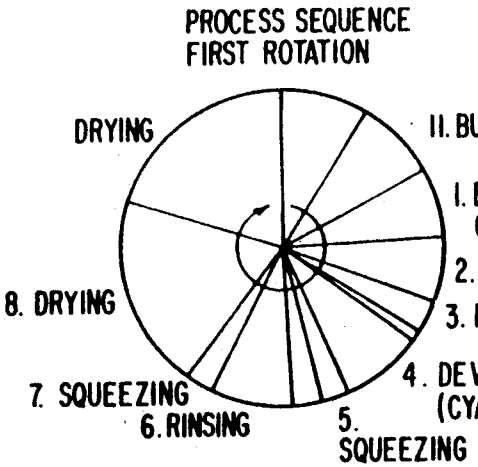

Upon input a start signal, the photoconductive drum 34 rotates in the clockwise direction of FIG. 1 by means of a driving means (not shown) and a corona charger 35 is actuated to uniformly charge the upper surface of the photoconductive material 34A by a DC corona discharge (see FIG. 5A). When the image forming portion of the photoconductive material 34A, the surface of which is uniformly charged, reaches the exposure position, a laser beam emitted from the semiconductor laser 12 is modulated according to its image information so that the photoconductive material 34A is exposed (FIG. 5A).

When the surface of the photoconductive material 34A is exposed, its portion illuminated by the laser beam turns electrically conductive to move the positive charges on the surface to form an electrostatic latent image corresponding to the image information.

The photoconductive material 34A having the latent image formed on its surface is further rotated in the clockwise direction, as viewed in FIG. 1, with the result that the portion of the photoconductive material 34A where the latent image is formed reaches a position opposed to the porous plate 58. At this time, at the prewet unit 50, the carrier solution is supplied to the chamber 52 by means of the carrier solution supply means.

Figure 4A:
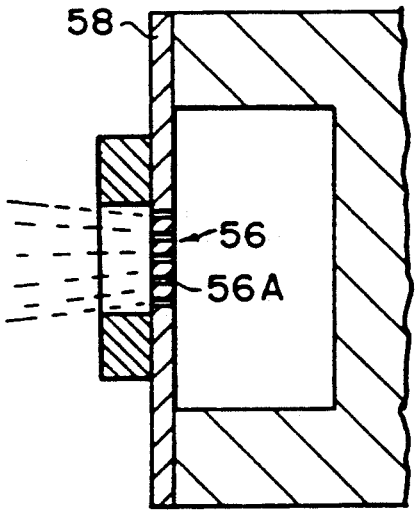
FIG. 4A and 4B are respectively a cross-sectional view for revealing the operation of the prewetting unit.

In addition, a voltage is applied to the ultrasonic vibrator 60 by a voltage applying means (not shown) with the result that the ultrasonic vibrator 60 vibrates at a predefined frequency and amplitude corresponding to those of the applied voltage. This applied voltage is set according to the amount of carrier solution applied to the photoconductive material 34A. If this amount is increased (the carrier solution is thickly applied), then the voltage is elevated and the amplitude is increased. On the contrary, if it is reduced (the carrier solution is thinly applied), then the voltage is lowered and the amplitude is reduced. This application of voltage causes the ultrasonic vibrator 60 to alternately position between the initial position (FIG. 4A), where its end surface 60A lies in the same plane as the porous plate 58, and the position of FIG. 4B, where the ultrasonic vibrator 60 is yielded in a substantially L-shaped form, and the end surface 60A presses the porous plate 58 in the direction in which it pressurizes the carrier solution stored within the chamber 52.

Figure 4B:
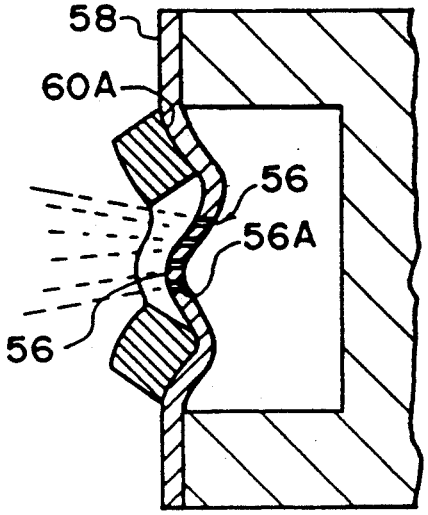

As seen in FIG. 4B, this vibration causes the intermediate portion of the porous plate 58 to vibrate in a waveform with the result that the carrier solution within the chamber 52 is injected onto the photoconductive material 34A in the form of fine droplets from a plurality of small holes 56A formed at each of the plurality of spray portions 58 formed in the axial direction of the photoconductive material 34A (FIG. 5A, prewetting). Thus, the carrier solution can be uniformly applied on the surface of the photoconductive material 34A. In addition, since prewetting can be achieved without making the prewet unit 50 come in contact with the photoconductive material 34A, no damage will be done to the photoconductive material 34A during prewetting prior to the developing process. And yet since the carrier solution is applied in the form of droplets, the carrier solution can be thinly applied to the photoconductive material 34A.

The prewet portion of the photoconductive material 34A is further rotated in the clockwise direction, as viewed in FIG. 1, to a position corresponding to the developing agent unit 36. In a case, the developing agent unit 36 is provided in which a liquid developing agent containing the black toner particles is stored. This developing agent unit 36 allows the liquid developing agent to be applied to the area for forming the latent image via the developing roller 40 (FIG. 5A, developing).

Figure 6A:
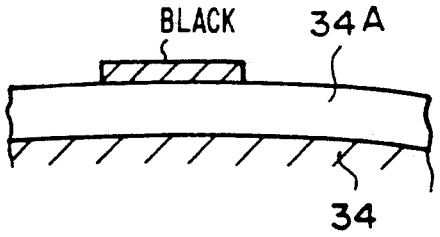
FIG. 6A through 6D are respectively a cross-sectional view illustrating a process in which an image of four layers is formed onto the photoconductive material.

Thus the negatively charged toner particles within the developing agent adhere to the image portion for forming the latent image and the latent image is developed so that the toner image corresponding to the image portion or non-image portion is formed (FIG. 6A).

The portion of the photoconductive material 34A, on the surface of which the toner image is formed, is further rotated in the rotating direction of FIG. 1 until it reaches a position corresponding to the squeeze unit 41. The portion where the toner image is formed is squeezed by the blowing of air from the air ejecting portion 41A thereby causing the excess liquid developing agent 38 to go into the developing tank 37 (FIG. 5A, squeezing). The time taken from the start of electric charge until the completion of squeezing is 3.9 sec. There is little dark decay (time constant of dark decay 10 sec). Therefore, the decay of the charge on the surface of the photoconductive material 34A can be inhibited enough so that a high quality toner image can be achieved after transfer, as will be later described. The above-described portion of the photoconductive material 34, where the toner image is formed, is further rotated in the clockwise direction, as seen from FIG. 1, until it reaches a position corresponding to the rinse solution unit 42 which is filled with rinse solution 44. The rinse solution 44 is supplied onto the surface of the photoconductive material 44 via the rinse roller 46 in order to wash away the developing agent containing unnecessary particles which adhere to the portion of the photoconductive material 34A but not the image portion where the toner adheres (FIG. 5A, rinsing).

The rinse solution 44 excessively supplied to the photoconductive material 34A flows away in the downstream direction along the outer circumferential surface of the photoconductive material 34A and around the lowermost portion P1 thereof, where it is removed from the surface of the photoconductive material 34A by air ejected from the air ejecting portion 43A of the squeeze unit 43. The rinse solution 44 then flows into a passageway 43C for delivery into the waste solution tank (not shown) via a line 49B (FIG. 5A, squeezing).

In addition, the liquid development agent which cannot be removed by the above-described squeeze unit 41 flows in the downstream direction along the outer circumferential surface of the photoconductive material 34A and around the lowermost portion of the outer circumferential surface (around the position P1). Here, the developing agent is removed from the surface of the photoconductive material 34A by air ejected from the air ejecting portion 43A of the squeeze unit 43 and flows into the line 43B for delivering the developing agent. This developing agent is introduced into a waste solution tank (not shown) via the line 49B (FIG. 5A, squeezing 2). As seen from above, in the squeeze unit 43, since air is blown in the neighborhood of the lowermost portion of the outer circumferential surface to eliminate the liquid developing agent and rinse solution, a mix of the liquid developing agent and rinse solution does not occur on the outer circumferential surface of the photoconductive material 34A.

The photoconductive material 34A is further rotated in the clockwise direction of FIG. 1 to face a port portion 66A of an exhaust duct 55, from which dry air supplied from a blower (not shown) is blown onto the surface of the photoconductive material 34A. By this dry air, the surface of the wet photoconductive material 34A is dried (FIG. 5A, drying).

The photoconductive material 34A is further rotated in the clockwise direction of FIG. 1 from this state to start a second rotating cycle, in which only the drying treatment is performed (FIG. 5B, drying).

By this drying operation, the rinse solution and carrier solution, which exist between the toner particles forming the latent image, are evaporated to increase the interaction (binding force) between them.

With the third cycle rotation of the photoconductive material 34A, the portion opposed to the corona charger 35 is sequentially electrically discharged by an AC corona discharge caused by the corona charger 35 (FIG. 5C, removal of electricity).

Further, supplied to this portion, where the electricity has been removed, is a light emitted from the halogen lamp 11 and which has passed through a filter (not shown) to remove the electric charge remaining on the photoconductive material 34A, from which electricity has been removed (FIG. 5C, removal of electricity by optical means). Afterwards, the drying operation is continued until the third cycle rotation is competed.

Subsequently, the second color (yellow) image forming process, that is, the second cycle, is proceeded to (fourth cycle). In this second color application process, the cleaning brush 77 is made to abut against the outer circumferential surface of the photoconductive material 34A by a driving means (not shown) and is further rotated by an electric motor (not shown). As a result, the cleaning brush 77 slides along the surface of the photoconductive material 34A to remove foreign matter adhering thereto (FIG. 5D, buffing). In this case, since the cleaning brush 77 is sufficiently softened as compared with the toner particles, the first color toner image will not be disturbed allowing a high quality recording of the toner image according to the overlapping recording method. In this cleaning process, since the air within the columnar body of the cleaning brush 77 is delivered to the outside the suction of a suction means (not shown), foreign matter such as a contaminant or the like is removed from the photoconductive material 34A through cleaning and prevented from adhering again thereto. Incidentally, in the cleaning process by the cleaning brush 77, the cleaning portion 76 is separated from the outer circumferential surface of the photoconductive material 34A by a drive means (not shown).

With rotation of the photoconductive material 34A, the portion of the photoconductive material 34A, which is now free of foreign matter, is sequentially electrically charged (FIG. 5D, electrical charging). In addition, the laser beam in the infrared region, which is illuminated from the semiconductor laser 12, is modulated according to the image information about the second color image to be copied, which is stored within the memory 15, to be illuminated onto the photoconductive material 34A. As a result, the photoconductive material 34A is exposed (FIG. 5D, exposure) and an electrostatic latent image is formed thereon. In this case, since the laser beam in the infrared region passes transparently through the first color toner image, the portion of the photoconductive material 34A, where the toner image was formed, is also exposed and the second color image was written. Incidentally, within the memory 15, the second color image is stored which has been fed from the host computer 22 during the above-described first cycle. That is, in this embodiment, although data writing is conducted at a fast speed, as described above, since the second color image information fed from the host computer 22 to the memory 15 utilizing the above-mentioned time required for drying is stored, it is possible to secure a data transfer speed that will allow the data writing.

Figure 6B:
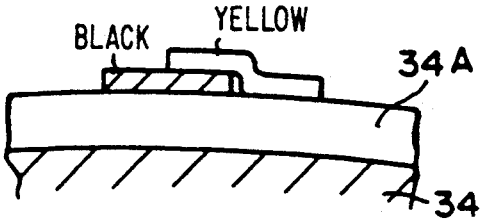

Prior to developing, the portion of the photoconductive material 34A, where the electrostatic latent image is formed, is prewetted, as described above, and is subjected to the above-described developing after steps are taken so that the toner particles do not adhere to the non-image portion, to be overlapped on the toner image with the preceding black toner image to form a yellow toner image (FIG. 5D, developing, FIG. 6B). Incidentally, at this time, the developing agent unit 36 has been shifted so that the unit storing a developing agent containing the yellow toner may come in contact with the surface of the photoconductive material 34A. Then, as previously described, squeezing 1 (FIG. 5D), rinsing (FIG. 5D), squeezing 2 (FIG. 5D) and the drying operation (FIG. 5D) are conducted.

Next, as in the process for applying the first color toner particles, drying is conducted during a fifth cycle rotation of the photoconductive material 34A (FIG. 5E, drying) and further during a sixth cycle rotation, removal of electricity (FIG. 5F, removal of electricity), exposure (FIG. 5F, exposure) and drying are conducted. The second toner image formed on the photoconductive material 34A is sufficiently dried by the drying operations made after the fourth cycle electric charging, exposure and developing until the sixth cycle rotation is completed, to allow the formation of the third color image.

Figure 6C:
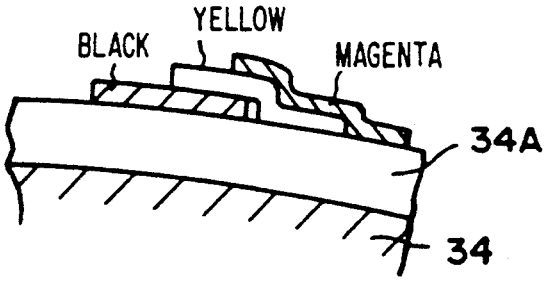

Next, the third cycle process is carried out. The second color liquid developing agent containing the third color (magenta) toner particles so that overlapped on the photoconductive material 34A with the toner image formed by the yellow toner particles, a toner image is formed by the yellow toner particles, and a toner image is formed by magenta toner particles. By so doing, three layers of toner are formed on the photoconductive material 34A with each of the black, yellow and magenta toner particles (FIG. 6C).

When the fourth color (cyan), that is, the last color is applied (fourth cycle), as when the second and third colors are applied, buffing for removing foreign matter with the cleaning brush 77 (FIG. 5G, buffing), electrical charging (FIG. 5G), exposure (FIG. 6G, exposure) and prewetting (FIG. 5G, developing) are conducted. After preventing the target particles from adhering to the non-image portion, developing (FIG. 5G) is carried out so that a cyan toner image may be formed to overlap the magenta toner image. Thus, four toner layers comprising black, yellow, magenta, and cyan are formed. Afterwards, as previously described, squeezing 1 (FIG. 5C), rinsing (FIG. 5C), squeezing 2 (FIG. 5D) and drying (FIG. 5G) are conducted. The above-described operations are conducted during a single turn of the photoconductive drum 34. Incidentally, in the above-described exposure, the laser beam within the infrared region passes transparently through the first to the third toner image so that the fourth color image information is written onto the photoconductive material 34A.

Figure 5H:
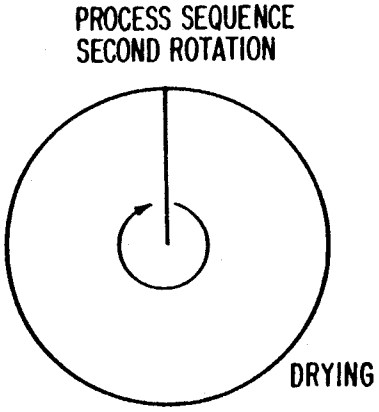
Figure 5I:
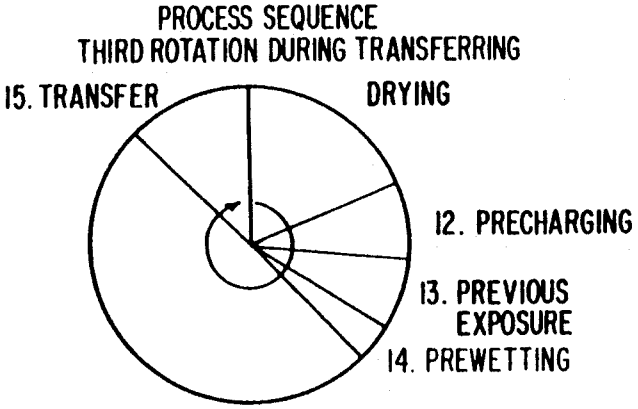

The drying operation is achieved during a period of time when the photoconductive material 34A further rotates in the clockwise direction of FIG. 1 (FIG. 5H, drying). Only drying is conducted during the second rotation of this last color.

Further, by rotation of the photoconductive material 34A, the third rotation of the last color is started. At this third rotation, first DC corona discharge by the corona charger 35 causes the electric charges of the same polarity as in the toner to be applied to the photoconductive material 34A to achieve precharging (FIG. 51, precharging).

The precharged portion of the photoconductive material 34A is further rotated in the clockwise direction of FIG. 1 to reach a position corresponding to the halogen lamp 11. light emitted from the halogen lamp 11 and passing through the filter is supplied to the photoconductive material 34A to achieve previous exposure (FIG. 51, previous exposure).

The previously exposed portion of the material 34A is further rotated in the clockwise direction of FIG. 1 reaching a position corresponding to the prewet unit 50. From the prewet unit 50, as described above, the carrier solution in the form of droplets is ejected to be applied to the previously exposed portion for prewetting prior to transfer (FIG. 51, prewetting). Also in this prewetting, since the carrier solution within the chamber 52 is injected onto the photoconductive material 34A in droplets from a plurality of small holes 56A formed at each of a plurality of spray portions 58 which are formed in the axial direction of the photoconductive material 34A, it can be uniformly applied onto the surface of the previously exposed portion, In addition, since the prewetting can be achieved without the prewet unit 50 coming in contact with the photoconductive material 34A, in the prewetting process prior to the transfer process, no damage will be given to the toner image applied to the photoconductive material 34A.

Figure 6D:
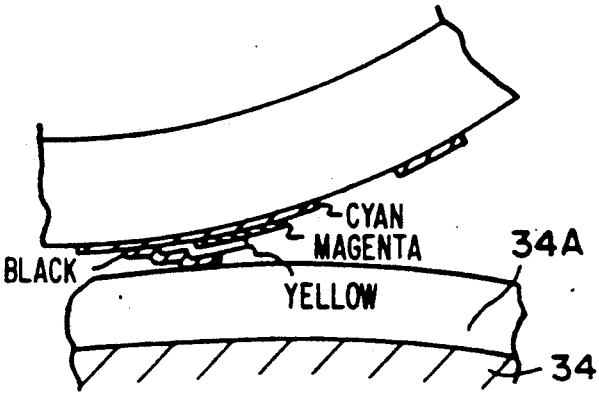

Meanwhile, the transfer material guided to a position pinched by the photoconductive material 34A and the roller 72 by a guide 74 receives a transferred image of the above-described four colors, pinched by the portion of the photoconductive material 34A, where the four particle layers of four colors are formed (FIG. 6D). Thus a copy image is formed on the surface of the transfer material. In this case, since the toner image of four layers formed on the photoconductive material 34A is transferred simultaneously onto the transfer sheet, a color toner image free from color drift can be transferred onto the transfer sheet.

Figure 5J:
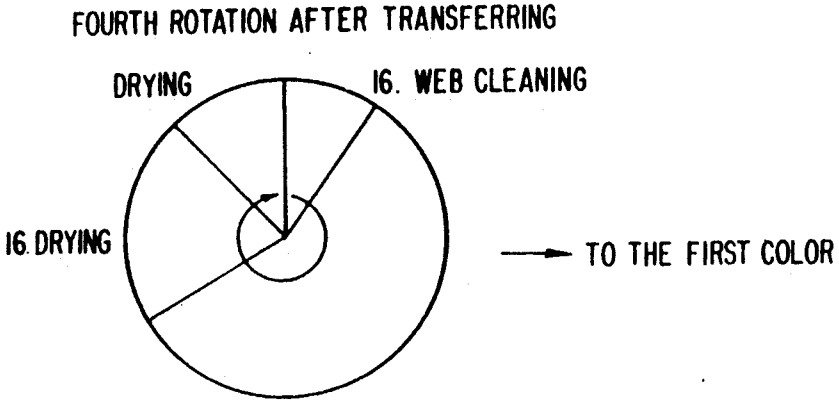

Then, the photoconductive drum 34A is rotated in the clockwise direction of FIG. 1 to shift to the cleaning process by the cleaning portion 76. In this cleaning process, the cleaning portion 76 is shifted in the direction in which it abuts the outer circumferential surface of the photoconductive material 34A by means of a drive means (not shown) so that the cleaning web abuts the photoconductive material. In addition, the cleaning web 82 is wound in the clockwise direction by means of a take-up roller 78. The cleaning roller 84, following the above-described winding action, is rotated in the clockwise direction, and with this rotation, the carrier solution flows out from the through holes 84A so that the portion of the cleaning web 82, which is permeated with the carrier solution, slides along the surface of the photoconductive material 34A to remove the toner remaining after the transfer step (FIG. 5J, web cleaning). As a result, the reproducibility of the transfer can be increased even if the photoconductive material 34A is repeatedly used. Incidentally, in the cleaning process by the cleaning portion 76, the cleaning brush 77 is separated from the outer circumferential surface by means of a drive means (not shown). After this cleaning process, a drying operation is conducted (FIG. 5J, drying) and the photoconductive material 34A is restored to the initial condition of FIG. 5A prior to exposure.

Incidentally, in the above description, although the negatively charged toner particles are used, positively charged toner particles may be used, in which case the photoconductive material 34A is negatively charged.

In addition, in this embodiment, although the squeeze unit 43 is disposed between the developing agent unit 36 and the rinse unit 42, any position may be selected so long as air can be blown to the neighborhood of the lowermost portion of the outer circumferential surface of the phoptoconductive material 34A.

Incidentally, in this embodiment although the cleaning portion 76 abuts and is separated from the outer circumferential surface of the photoconductive material 34A, it may be arranged so that the cleaning roller 84 may abut and be separated from the outer circumferential surface of the photoconductive material 34A.

In addition, although this embodiment uses four color toners, it may be applied to a case in which the color toner using at least two colors is used. In addition, in this embodiment, although a single cycle is arranged to be completed with three rotations of the photoconductive drum 34, more than three rotations may be used. In this case, the number of rotations for one cycle is set by considering the time needed for the toner image formed on the photoconductive material 34A to dry.

In addition, in this embodiment, although as the photoconductive material 34A amorphous silicon, which is sensitive to the light in the infrared region, is used, it is conceivable to use a photoconductive material which is sensitive to the light in the ultraviolet region. In this case, a toner which does not easily absorb the light used for exposure is used.

In addition, in this embodiment, at the start of the first rotation of the first color, cleaning and/or removal of electricity may be conducted.

Next, a second embodiment is described.

In describing this embodiment, the same arrangements, materials, portions and the like as in the first embodiment are designated the same signs as used therein and their description is omitted.

Figure 12:
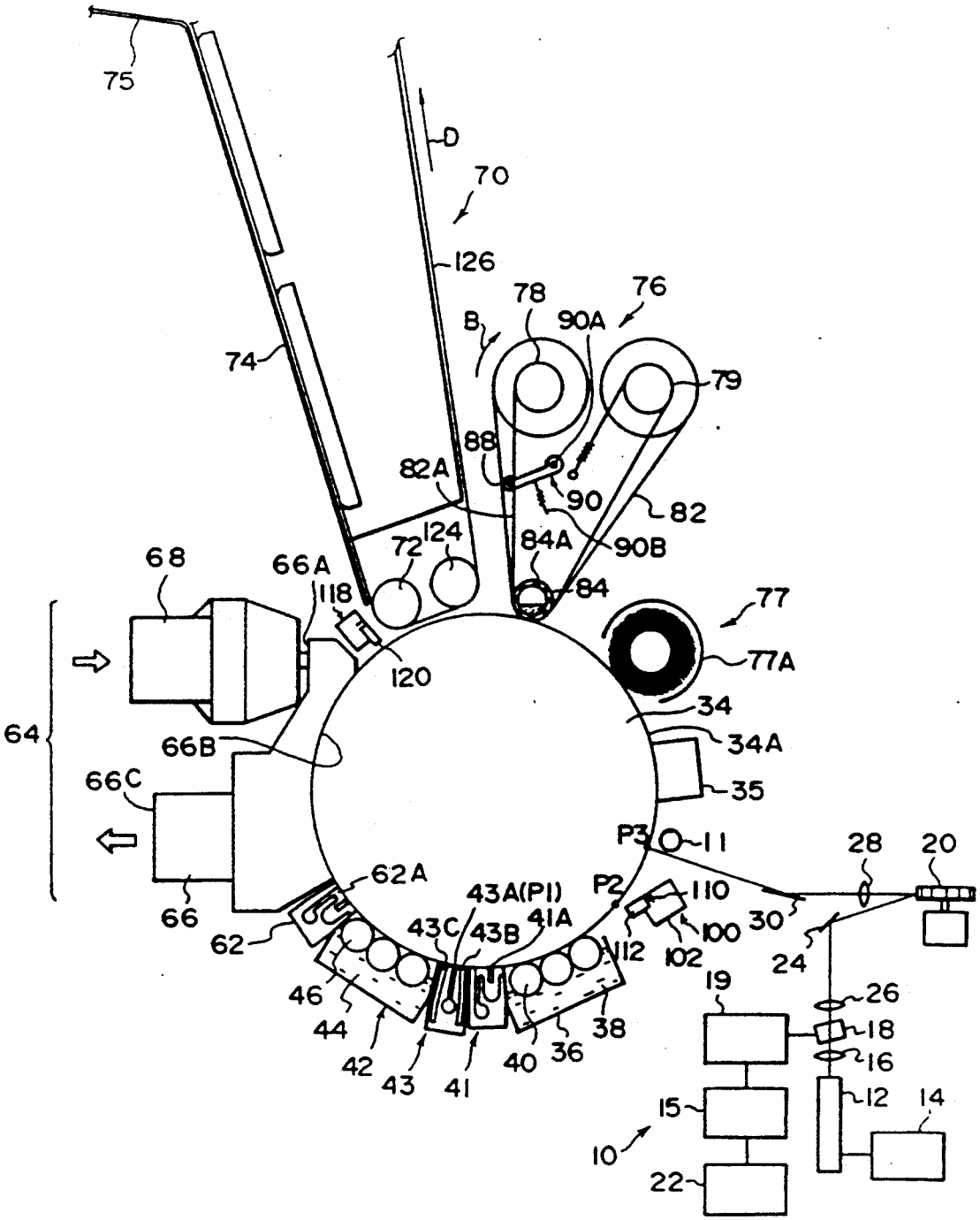
FIG. 12 is a layout view of each processing unit which forms an apparatus according to a second embodiment of the present invention.

As shown in FIG. 12, provided downstream of the position P3 where the laser beam comes incident upon the photoconductive material 34A (closer to the rotating direction of the photoconductive drum 34 than the incident position) is a prewet unit 100 which is different from the prewet unit 50 of the first embodiment. The distance (circumferential length) between the position P2 opposed to the prewet unit 100 and the position P3 is set to be about 50 mm.

Figure 13:
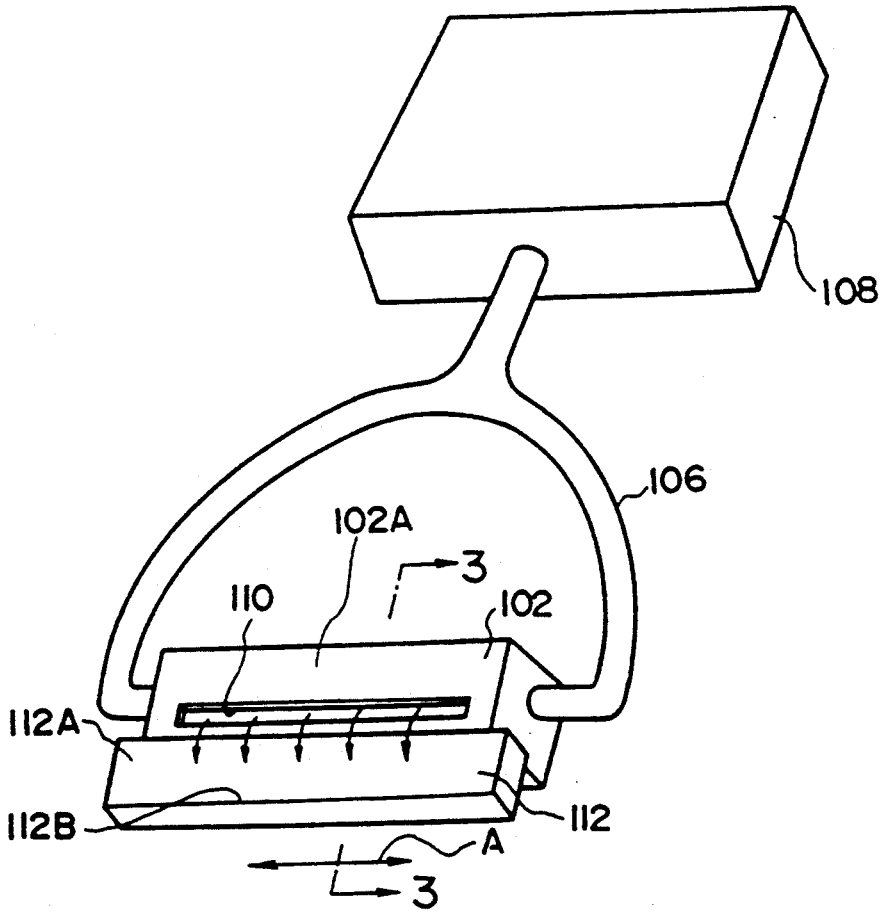
FIG. 13 is a perspective view of a transfer unit according to the second embodiment.
Figure 14:
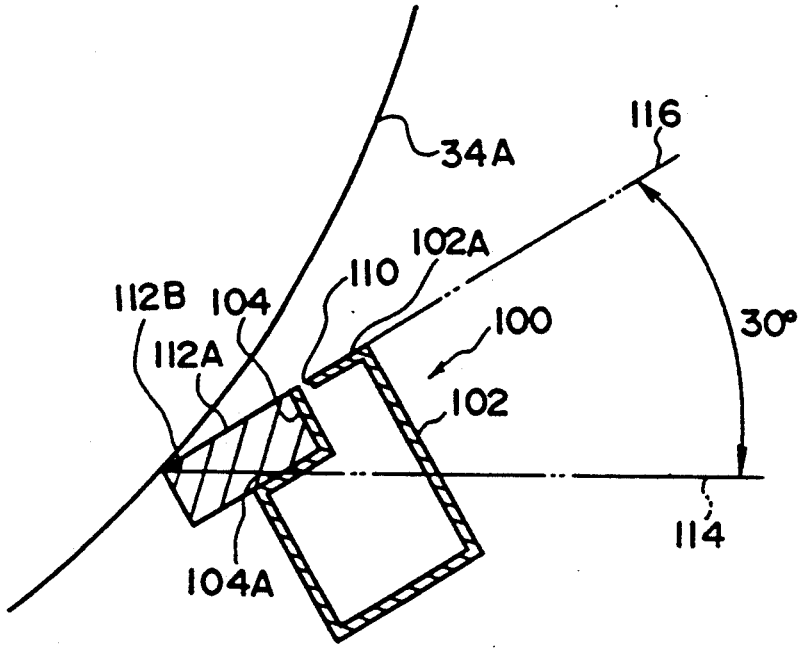
FIG. 14 is a cross-sectional view of the prewetting unit taken along line 3—3 of FIG. 13.

The prewet unit 100 is provided with a chamber 102, into which the carrier solution flows. As shown in FIGS. 13 and 14, the chamber 102 is formed in a substantially rectangular parallelopiped form. At part of the surface 102A opposed to the photoconductive material 34A, a substantially L-shaped recess 104 is formed extending in the axial direction of the same. The chamber 102 is mounted in such a way that its longitudinal direction (indicated by arrow of FIG. 13) runs along the axial direction of the photoconductive material 34A. In addition, at the substantially central portion of the opposed surface 102, a slit 110 is formed extending in the axial direction of the photoconductive material 34A. The chamber 102 is coupled to a means 108 for supplying the carrier solution via a line 106. A carrier solution is supplied to the chamber 102 by means of this means 108. The means 108 is arranged so that it may adjust the amount of carrier solution to supply to the chamber 102.

Disposed at the bottom portion 104A of the recess portion 104 is a planar and rectangular blade 112. This blade 112 is disposed with its longitudinal direction running in the axial direction of the photoconductive material 34A. The blade 112 is made of an insulating material such as glass so that it may not be discharged even if it contacts the photoconductive material 34A. As shown in FIG. 14, the upper surface 112A of the blade 112 opposed to the photoconductive material 34A lies in the same plane (slit forming plane) 116 as that of the opposed surface 102A. In addition, an angle formed by the plane 116 and the horizontal plane 114 is set to be about 30 degrees. By so doing, the carrier solution which flows out of the slit 110 can be readily supplied to the edge portion 112B of the blade 112.

This edge portion 112B extends in the axial direction of the photoconductive material 34A and the gap between this edge portion 112B and the outer circumferential surface of the photoconductive material 34A can be adjusted to about 10 um to 500 um by means of a drive means such as a solenoid (not shown). Adjustment of this gap dimension allows an amount of the carrier solution formed between the edge portion 112B and the photoconductive material 34A to be adjusted. In addition, the film thickness of the carrier solution which is applied to the photoconductive material 34A may be set to about 5 um to 200 um by adjusting the amount of carrier solution supplied from the above-described means 108 to the chamber 102.

In addition, in this embodiment, disposed downstream of a suction chamber 68 is a prewet unit 118, in which the gap between the edge portion 120 and the outer circumferential surface of the photoconductive material 34A is set greater than that between the edge portion 112B and the outer circumferential surface of the photoconductive material 34A. As a result, a larger amount of carrier solution is applied to the photoconductive material 34A than by the prewet unit 100 and is sufficiently absorbed into the toner layer formed on the photoconductive material 34A Incidentally, the arrangement of the prewet unit 118 is omitted because it is the same as that of the prewet unit 100.

Figure 19:
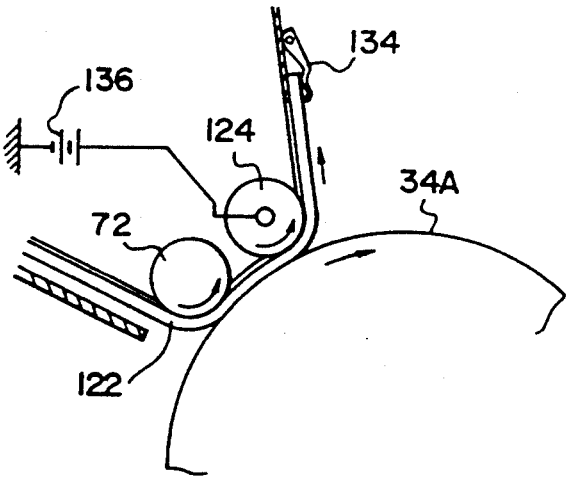
Figure 20:
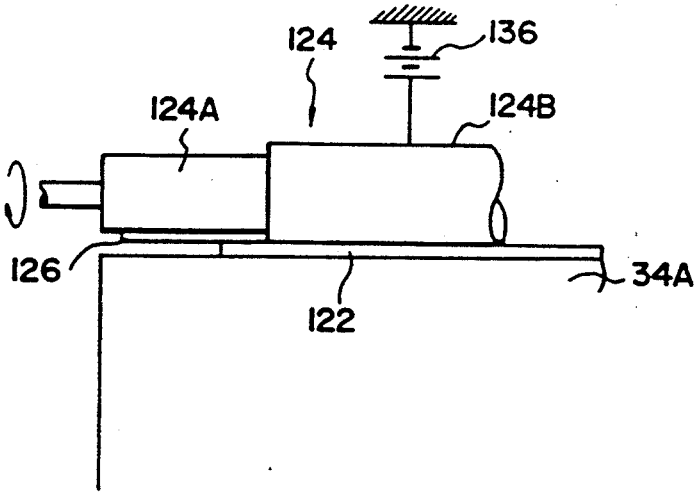
FIG. 20 is a lateral view for explaining the layout of the transfer roller, insulating sheet, transfer chart and the photoconductive material according to the second embodiment.

Disposed downstream of the prewet unit 118 (as viewed in the rotating direction of the photoconductive drum 349) is a transfer portion 170. This transfer portion 170 is shifted in the directions close to and away from the outer circumference of the photoconductive material 34A by means of a drive means (not shown). At the transfer portion 170, an adhesion roller 172 extending in parallel to the axial direction of the photoconductive drum 34 is provided close to the photoconductive material 34A. During the transfer step, the transfer portion 170, which lies spaced apart, comes in contact with the photoconductive material 34A, and the transfer material 122 comes in contact with the photoconductive material 34A, as shown in FIG. 19. In consequence, the transfer material 122 is shifted from the state in which it is spaced apart from the photoconductive material 34A, in the direction in which it comes close to the photoconductive material 34A, as shown in FIG. 19 until it is adhered to the photoconductive material 34A by contact bonding by the adhesion roller 172. Disposed downstream of the adhesion roller 172, as viewed in the rotating direction of the drum 34 is a transfer roller 124, which runs parallel to the axial direction of the drum 34. The transfer roller 124 is shifted in the direction close to and leaving the outer circumference of the photoconductive material 34A. As shown in FIG. 20, in the transfer roller 124, the outer circumferential surface of the columnar insulating material 124A is covered with an electrically conductive material 124B. Part of the insulating material 124A protrudes from the end portion of the material 124B. At the time of transfer, a transfer electric field is applied to the material 124B by a means 136 for applying transfer voltage.

Interposed between the adhesion roller 172 and the transfer roller 124 and the photoconductive material 34A is an insulating sheet 126 made of the insulating material, which forms part of the transfer portion 170. As shown in FIGS. 19 and 20, one end of the insulating sheet 126 is mounted to the outer circumferential surface of the roller 128 while the other end is mounted to the outer circumferential surface of the roller 130 via a tension roller 140. The rollers 128, 130 are disposed with their axial direction running parallel to the same direction of the drum 34. In addition, the rollers 128, 130 are alternately rotated in the counterclockwise direction by means of a motor (not shown) so that the insulating sheet 126 reciprocates along the outer circumferential surface of the photoconductive material 34A. In this case, the driving force by the roller 128 is made greater than the adsorbing forces of the transfer material 122 and photoconductive material 34A and smaller than the frictional forces of the same. As a result, the transfer material 122 mounted to an opening portion 126A (described later) of the insulating sheet 126 is carried at the same speed as the circumferential speed of the photoconductive material 34A.

Figure 15:
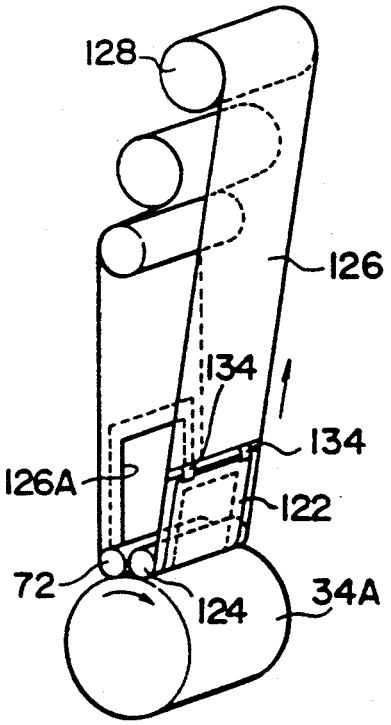
FIG. 15 is a perspective view of the transfer unit according to the second embodiment.
Figure 21:
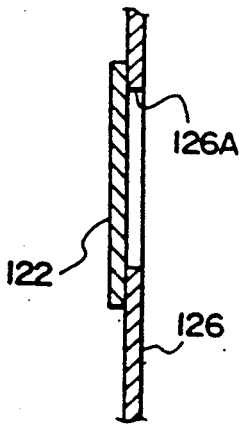
FIG. 21 is a cross-sectional view of the insulating sheet attached with the transfer material as cut away in the longitudinal direction thereof.

As shown in FIGS. 15 and 21, a rectangular opening portion 126A is formed at a substantially central portion of the insulating sheet 126, which runs in its longitudinal direction. As shown in FIG. 15, the electrically conductive material 124B is disposed in the crosswise direction of this opening portion 126B. Its opening area is made smaller than that of the transfer material 122. The transfer material 122 is mounted in the shifting direction of the transfer material 122 at the peripheral edge portion of the opening portion 126A (in the take-up direction of the roller 128) from the outside of the transfer portion 70 of the opening portion 126A to be retained by a pair of retaining means 134 swiveled with the axis 134A as its center. As a result, the transfer material 122 is exposed from the insulating sheet 126 so as to directly abut the conductive material 124.

Figure 16:
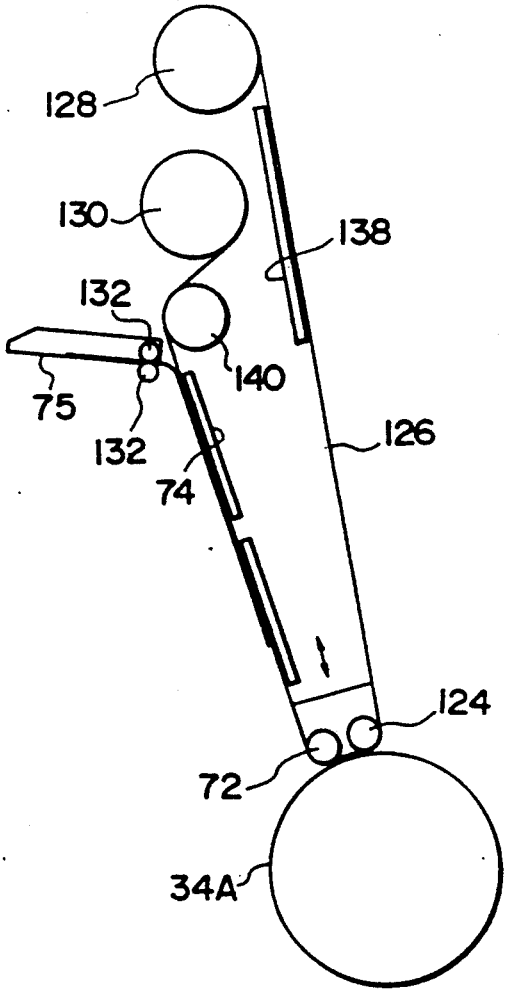
FIG. 16 is a lateral view of the transfer unit according to the second embodiment.
Figure 17:
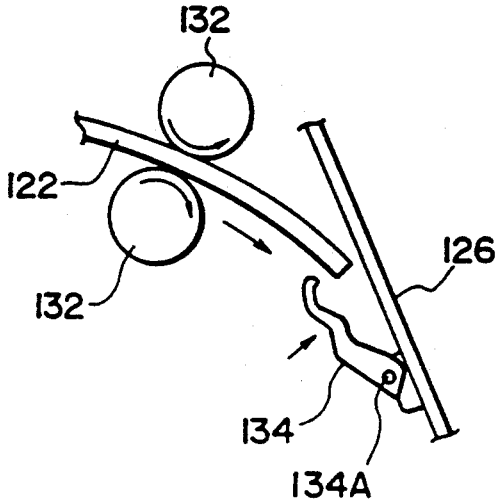
FIG. 17 is an enlarged lateral view of a retaining means of the transfer unit according to the second embodiment.

As shown in FIG. 16, a pair of guide rollers 132 are provided at the inner side of the transfer portion 170 of a tray 75 for storing the transfer material 122. As shown in FIG. 17, pinched by the guide rollers 132, the transfer material 122 reaches the peripheral edge portion of the opening portion 126A. The transfer material 122 which is set in the tray 75 is integrally conveyed with the insulating sheet 126 movably guided by the transfer guides 74, 138 (see FIG. 16) until it reaches the position where it is sandwiched between the transfer roller 172 and the photoconductive material 34A to be transferred.

Figure 22:
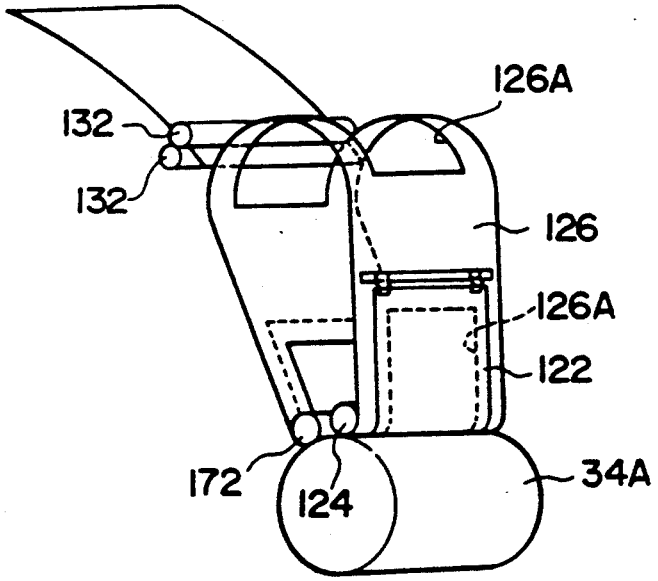
FIG. 22 is a perspective view illustrating the transfer unit according to another embodiment of the present invention.

In FIG. 22, a modified example of the transfer portion 170 is illustrated. This example and the second embodiment are different in the arrangement of the insulating sheet 126. In the modified example, the insulating sheet 126 is endlessly formed. In addition, a plurality of opening portions 125A are formed at the insulating sheet 126. The modified example is effective for continuous treatment because the transfer speed can be improved by mounting the transfer material 122 at each opening portion 126A. In addition, by altering the size of the opening portion 126A, it becomes possible to achieve continuous transfer to the transfer material of different size.

The other arrangement of this embodiment is the same as that of the first embodiment, and its description is omitted.

In describing the operation of this embodiment, the same operation as in the first embodiment is basically omitted, but if necessary, it will be described with reference to FIG. 5.

In the process sequence corresponding to the first rotation of the first color of FIG. 5, the photoconductive material 34A on the surface of which an electrostatic latent image is formed by a semiconductor laser 12 is further rotated in the clockwise direction of FIG. 2, and the portion of the photoconductive material 34A, where the latent image was formed, reaches a position opposed to the prewet unit 100. At this time, at the prewet unit 100, the carrier solution is supplied into the chamber 102, into which the carrier solution flows, by the means 108 for supplying the carrier solution.

The carrier solution within the chamber 102 passes through the slit 110 to reach the edge portion 112B along the upper surface of the blade 112 to form a well between the edge portion 112B and the outer circumferential surface of the photoconductive surface 34A. When the photoconductive material 34A is rotated from this state, the carrier solution flows out from the well by this rotation, and this carrier solution is applied in the form of a thin film to the surface 34A of the photoconductive material 34A.

As described above, in this embodiment, since prewetting can be achieved without the prewet unit 100 coming into contact with the photoconductive material 34A, no damage will be given to the photoconductive material 34A during the prewetting prior to the developing process.

Figure 23:
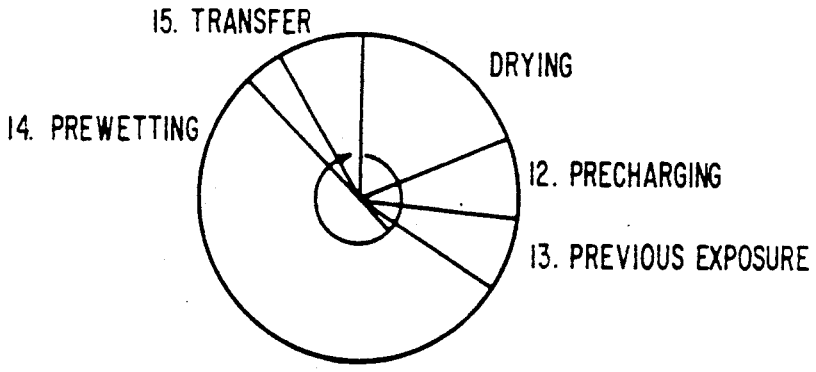
FIG. 23 is an explanatory view of part of the operation of the apparatus according to the present invention.

Further, after the previous exposure at the third rotation transfer is performed in the process corresponding to FIG. 51, that is, FIG. 23 of the last color process sequence, the photoconductive material 34A is rotated in the clockwise direction of FIG. 12, and its previously exposed portion reaches the position corresponding to the prewet unit 118. In this state, a well for the carrier solution is formed between the edge portion 120 and the photoconductive material 34A and the photoconductive material 34A is further rotated so that the carrier solution is applied to the previously exposed portion in the form of a film to achieve prewetting prior to transfer operation (FIG. 23, prewetting). In this prewetting prior to the transfer operation, since the amount of carrier solution to be applied is greater than in the prewetting prior to the developing, the carrier solution is sufficiently absorbed to the toner layer formed on the photoconductive material 34A so that the toner image is excellently transferred to the transfer material 122.

As described above, also in this prewetting prior to the transfer operation, since it can be performed without the prewet unit 118 coming in contact with the photoconductive material 34A, no damage is given to the photoconductive material 34A. In addition, since prewetting can be performed without making the prewet unit 118 contact the photoconductive material 34A, the toner which has adhered thereto in the prewetting prior to the transfer process becomes unlikely to peel off.

Figure 18:
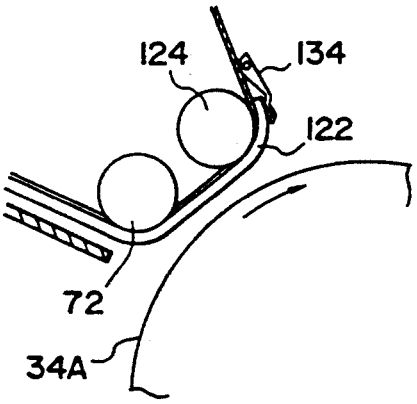
FIGS. 18 and 19 are respectively a lateral view for explaining the operation of the transfer unit according to the second embodiment.

Meanwhile, the transfer material 122 stored within the tray 75, guided by the guide rollers 132, reaches the peripheral edge portion of the opening portion of the insulating sheet 112 to be retained by the retaining means 134. The transfer material 122 retained by the opening portion 126A is moved in the direction of arrow D of FIG. 12 by the driving force of the roller 128 until it is guided by the guide 74 to a position sandwiched by the photoconductive material 34A and the adhesion roller 172. At this time, the adhesion roller 172 and the transfer roller 124 come close to the photoconductive material 34A so that the transfer material 122 closely adheres to the image forming area of the photoconductive material 34A. In addition, a transfer electric field is applied to the electrically conductive material 124B of the transfer roller 122 by means of a means for applying a transfer voltage. In this state, the transfer material 122 is sandwiched between the material 124B and the portion of the photoconductive material 34A, where the four color toner particles layer is formed to be carried at the same speed as the circumferential speed of the photoconductive material 34A. Thus, a transferred image is formed onto the transfer material 122 with the above-described four color toner layer (corresponding to FIG. 6D) and the toner image is transferred onto the surface of the transfer material. In this case, since the four layer toner image formed on the photoconductive material 34A is transferred bloc simultaneously onto the transfer sheet, it is possible to obtain a color toner image free from color drift. After this transfer, as seen in FIG. 18, the transfer portion 170 is separated from the photoconductive material 34A and the transfer roller 124 is separated from the photoconductive material 34A. In this state, the transfer material 122 is shifted up to a predetermined position of FIG. 12, as viewed in the direction of arrow D, with the insulating sheet 126 guided by guides 74, 138 by being wound by the roller 128, and being held by the retaining means 134 is released to be taken out. Thereafter, the insulating sheet 126 is wound by the roller 130 to be returned to the initial position of the peripheral edge of the guide roller 132. The above-described action is repeated to achieve the continuous transfer.

In this embodiment, since the transfer material 122 is carried integrally with the insulating sheet 126 guided by guides 74, 138, the transfer material 122 is excellently carried.

In this embodiment, although glass is used as a material for forming the blade 112, ceramics, thermosetting resin, and metal coated with the insulating material (for example, anodized aluminum) may be used.

Further, in this embodiment, although two prewet units are used, only one located immediately before the developing agent unit 36 may be used. In this case, in the prewetting prior to the transfer process, the prewet unit 100 is shifted by a drive means (not shown) such as a solenoid or he like to increase the gap between the edge portion 112B and the outer peripheral surface of the photoconductive material 34A than the prewetting prior to the developing process.

In addition, at the transfer portion 170, a sensor for sensing the tip end of the transfer material may be provided to synchronize the rotation of the photoconductive drum 34 with the adhering action of the transfer material 122 relative to the photoconductive material 34A. As a result, the transfer accuracy of the toner image relative to the transfer material 122 can be improved.

Next, a third embodiment is described with reference to the accompanying drawings.

In describing this embodiment, the arrangements, materials and the like similar to those of the first embodiment are designated with reference numerals identical to those of the first embodiment and their detailed description is omitted.

Image information supplied from a host computer 222 is stored into a memory 215 of this embodiment while information about each photoconductive material characteristic such as the electric charging characteristic, dark decay characteristic and the light sensitivity characteristic at each point on the photoconductive material 34A on the outer circumferential surface of the drum 34 (described later) is stored therein.

As the semiconductor laser 12, for example, Al-GaAs can be used. The laser beam emitted from the semiconductor laser 12 is illuminated to a multi AOM 18 via a condenser lens 16. In addition, a ultrasonic of different frequency, which is emitted according to the image information stored within the memory 215 is supplied to the multi AOM 18. As a result, the laser beam is diffracted in different directions according to the frequency of the ultrasonic.

Further, the laser beam is modulated by the multi AOM in light intensity according to the photoconductive material information (photosensitivity characteristic) of the photoconductive material 34A stored within the memory 215. In consequence, the unevenness of the photosensitivity of the photoconductive material 34A may be corrected by modulating this laser beam.

Figure 24:
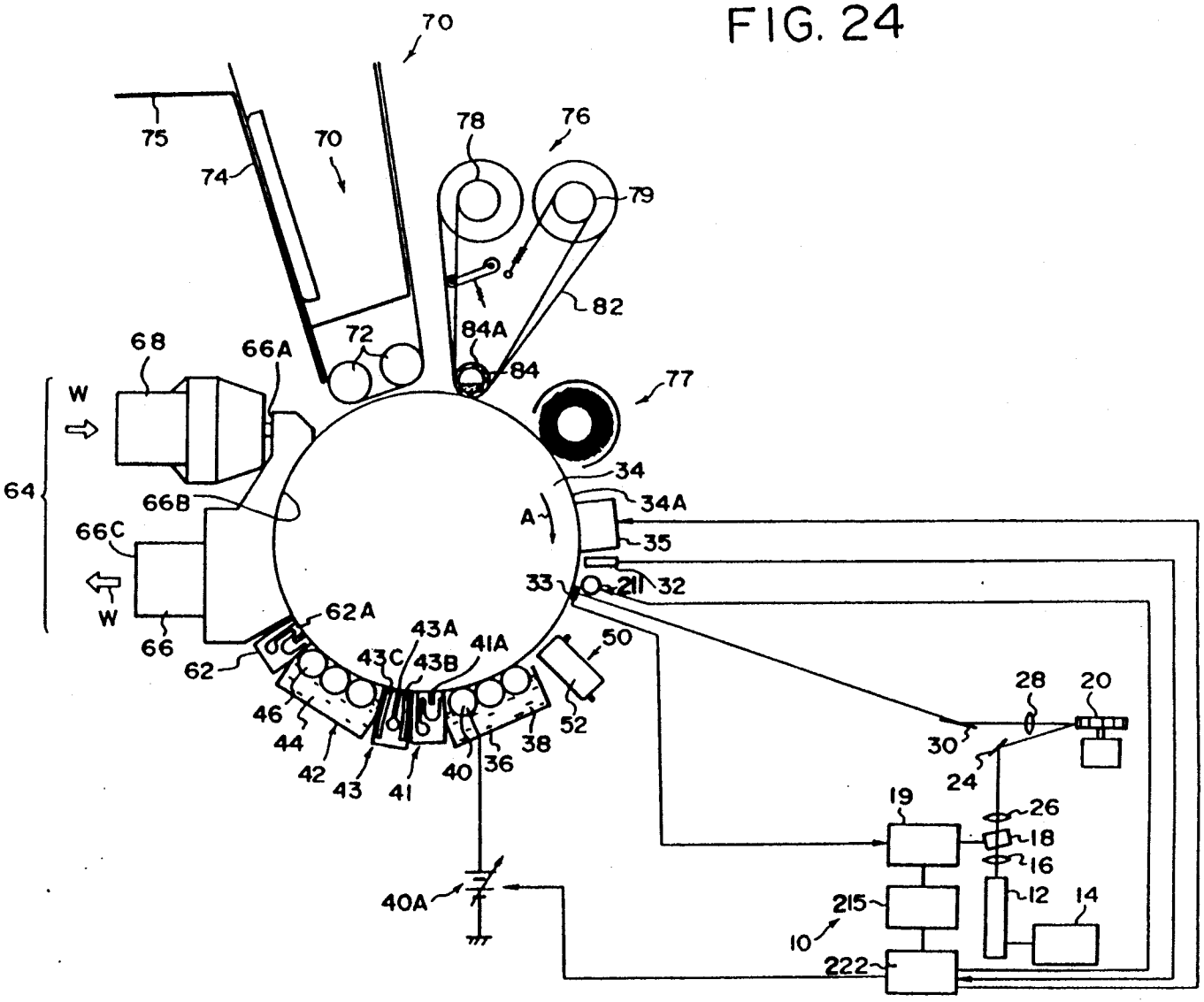
FIG. 24 is a layout view of each processing unit which forms an apparatus according to a third embodiment of the present invention.

The photoconductive drum 34 is connected to a drive means (not shown), which rotates the drum 34 in the clockwise direction of FIG. 24 (in the direction of arrow A of FIG. 24). In addition, the rotating angle of the drum 34 (the position of the drum 34 as it is rotated from its home position) is detected by a sensor for sensing the rotating position of the drum to be each input to a host computer 222.

The photoconductive material 34A is provided on the outer circumferential surface of the drum 34 made of aluminum. As this photoconductive material 34A, a known organic photoconductive material or inorganic photoconductive material may be used. In addition, a dielectric material electrically charged by an electrically charged stylus may also be used.

As the organic photoconductive material, various known ones are available. More specifically, those materials disclosed in "Research Disclosure" #10938 (from page 61 one, May, 1973, Article titled "Electrophotographic Element, Material and Process") may be given by way of example.

As ones served for practical use, for example, an electrophotographic photoconductive material comprising a poly-N-vinylcarbazole and 2,4, 7-trinitrofluorene-9-on (U.S. Pat. No. 3,484,237), poly-N-vinylcarbazole sensitized with a pyrilium salt series dyestuff (Japanese Patent Application Publication No. 48-25658), an electrophotographic photoconductive material including an organic pigment as its principal component (Japanese Patent Application Laid-Open No. 49-37543), an electrophotographic photoconductive material including an eutectic complex made of a dye and a resin as its principal component (Japanese Patent Application Laid-Open No. 47-10735), an electrophotographic conductive material with a copper phthalocyanine dispersed within a resin (Japanese Patent Application Publication No. 52-1667) and the like may be available. Other than those described above, there are other materials available, which are disclosed on page 62 to 76, NO. 3 (1968), Vol. 25, Transactions of the Electrophotographic Science Association).

In addition, as the typical inorganic photoconductive material used in this invention, various inorganic compounds disclosed on page 260 to 374, "Electrophotography", written by R. M. Schafer, Focal Press (London) are available. As the concrete examples, zinc oxide, zinc sulfate, cadmium sulfate, selenium, selenium-tellurium alloy, selenium-arsenic alloy, selenium-tellurium-arsenic alloy and the like may be given by way of example.

Other than those, amorphous silicon may also be used. This amorphous silicon, despite its rapid dark decay, is suitable for this embodiment because it can be repeatedly used.

Upstream taken in the rotating direction of the photoconductive material, where the laser beam becomes incident, a corona charger 35, which forms part of the image forming means, is disposed. This corona charger 35 is provided with a corona wire and a grid wire, the corona charger 35 being connected to AC and DC power supplies via a switch (not shown). In addition, the corona charger 34 is connected to the host computer 222, which forms part of the image forming means and the discharge voltage is controlled by the host computer 222, based on the information about the photoconductive material characteristics (electric charging characteristic, dark decay characteristic), which is stored within the memory 215 so that the uneven photoconductive material characteristic experienced in the rotating direction of the photoconductive material 34A may be corrected.

Thus, the photoconductive drum 34 prior to formation of the electrostatic latent image is rotated in the clockwise direction of FIG. 24 after the surface of the photoconductive material is positively or negatively charged.

Downstream of the corona charger 36 (as viewed in the rotating direction of the photoconductive drum 34), a plurality of surface potential sensors 32 disposed side by side in the axial direction of the drum 34 are disposed so that the surface potential at each point on the photoconductive material 34A (at a different point taken in the axial and rotating directions of the drum 34) may be sensed. In accordance with the output of sensors 32, the host computer 222 calculates the electric charging characteristic, dark decay characteristic and the photosensitivity characteristic to store these characteristics into the memory 215.

The portion of the photoconductive material 34A, where the laser beam becomes incident is turned electrically conductive and the electric charges on the surface disappear and an electrostatic latent image is formed on the surface of the photoconductive material 34A.

As shown in FIG. 24, disposed downstream of the surface potential sensors 32 (as viewed in the rotating direction of the photoconductive drum 34) is a LED array 211, which forms part of the image forming means.

Figure 25:
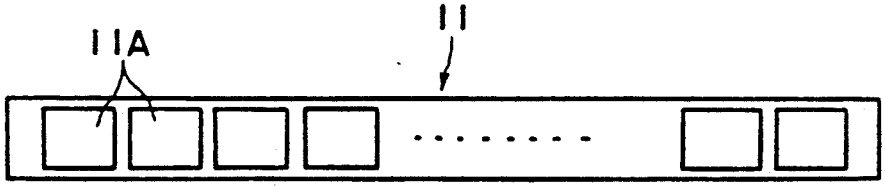
FIG. 25 is a plan view of a LED array used in the third embodiment.

As shown in FIG. 25, in the LED array 211, a plurality of LEDs (light emitting diodes) 211A are disposed side by side in the axial direction of the photoconductive drum 34 (in the crosswise direction of FIG. 25).

As shown in FIG. 24, LED array 211 is connected to the host computer 222, which forms part of the image forming means. Consequently, the amount of light emitted from each LED 211A may be adjusted based on the photoconductive material characteristics (electric charging characteristic, dark decay characteristic) stored within the host computer 222.

Figure 26:
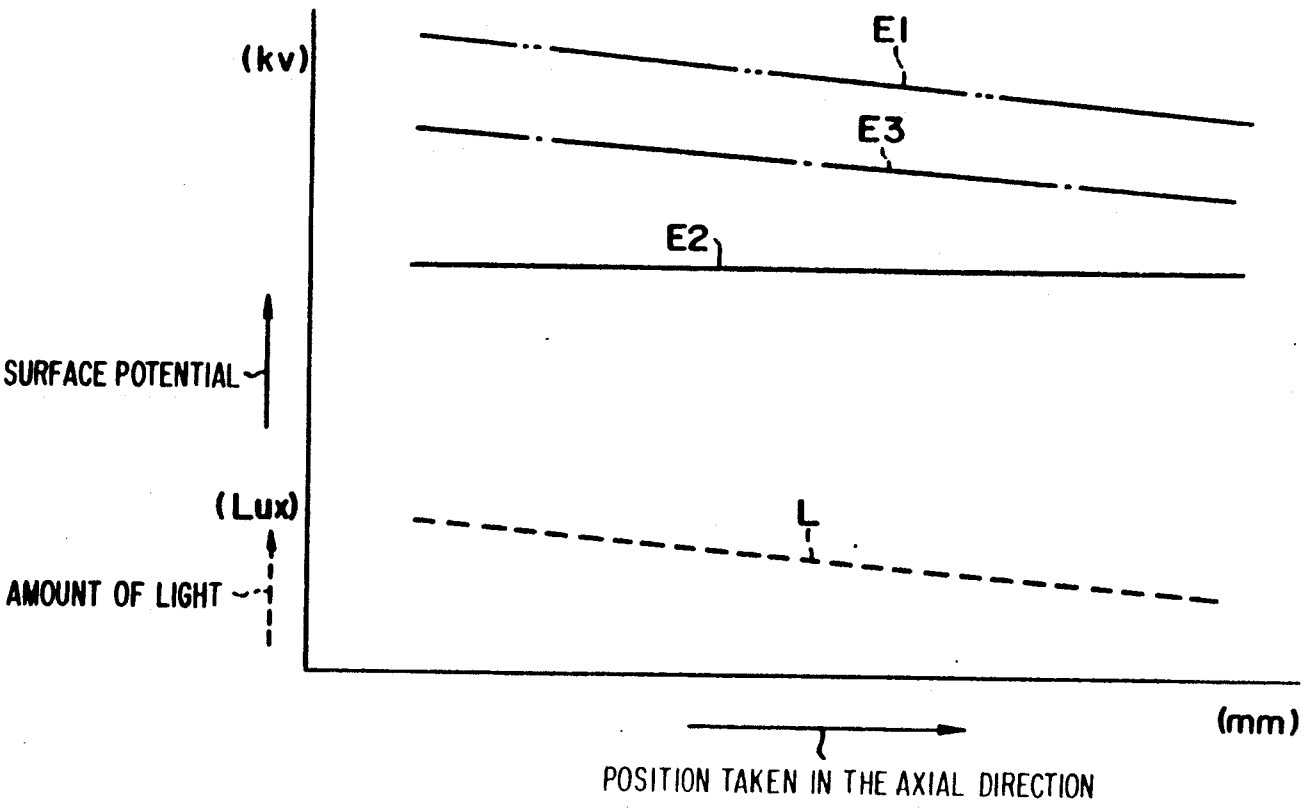
FIG. 26 is a surface potential distribution view illustrating how the surface potential is corrected by the LED array according to the third embodiment.

As a result, as shown in FIG. 26, in order to correct the uneven potential distribution (E1) in the axial distribution of the surface potential of the photoconductive material 34 electrically charged by the corona charger 35, a light amount (L) may be illuminated from LED array 211 under the control of the host computer 222 resulting in a uniform potential distribution (E2).

In addition, the electric charges on the photoconductive material 34A can be neutralized by illuminating the light of LED array 211 onto the photoconductive material 34A (e.g., removal of electricity by optical means). This removal may display a similar function as for the removal by the corona charger 35 while, as will be later described, achieving the previous exposure to increase the transfer efficiency for the toner adhering to the photoconductive material 34A.

As shown in FIG. 24, disposed at the position where the laser beam is incident on the photoconductive material 34A are a plurality of light amount sensors, which are disposed side by side in the axial direction of photoconductive drums 34 so that the amount of light beams which are incident onto the photoconductive material 34A may be sensed. In addition, these sensors 33 are connected to the host computer 222 and the amount of light beams, which is detected by the sensors 33, is fed back to the host computer 222 to achieve secure control of the amount of laser beams.

Disposed at the developing agent unit 36 are a plurality of developing rollers 40, which correspond to the image forming area and extend in the axial direction of the photoconductive drum 34. Part of the outer circumferential surface of this developing roller 40 is immersed in a liquid developing agent 28. These developing rollers 40 are rotated by a drive means (not shown).

In addition, the developing roller 40 is connected to a developing bias voltage controller 40A so as to be applied with the developing bias voltage. This controller 40A is connected to the host computer 222, which forms part of the image forming means, and the developing bias voltage may be controlled by the host computer 22 in accordance with the photoconductive material characteristic information stored within the memory 15 so that the amount of toner adhering in the rotating direction of the drum 34 may be corrected so as not to cause an uneven characteristic.

Other arrangements are similar to those of the first embodiment, and their description is omitted.

In this embodiment, an electric discharge is conducted at a predetermined voltage from the corona charger 35 toward the photoconductive material 34A to sense the surface potential at each point on the photoconductive material 34A (at different points taken in the axial and rotating directions of the drum 34) after a predetermined time by means of the surface potential sensor 32. Thus, the host computer 222 may calculate the electric charging characteristic and the dark decay characteristic at each point on the photoconductive material 34A in accordance with the sensed surface potential to store them into the memory 215.

Further, electric discharge is conducted at a constant voltage from the corona charger 35 toward the photoconductive material 34A, and a predetermined amount of light is illuminated from LED array 211 to the photoconductive material 34A to sense the surface potential at each point on the photoconductive material 34A (at different points taken in the axial and rotating directions of the photoconductive drum 34A) by the surface potential sensor 32. In accordance with the sensed surface potentials, the most computer 222 calculates the photosensitivity characteristic at each point on the photoconductive material 34A to store it into the memory 215.

Otherwise, before incorporating the photoconductive drum 34 into this apparatus, by another dedicated evaluating unit, the electrophotographic characteristics such as the surface potential, dark decay characteristic, photosensitivity, and the residual potential at each point on the photoconductive material 34A (at different points as taken in the axial and rotating directions of the photoconductive drum 34) may be measured in advance to store the data into the memory 215.

The following treatments are conducted in accordance with these data stored into the memory 215.

In this embodiment, after the black image is formed, each of the yellow, magenta and cyan images are formed overlapped thereon. In addition, in this embodiment, a developing agent including the negatively charged toner particles is used.

First, a case is described in which the black image is formed onto the photoconductive material 34A. The image information about the image to be copied is supplied from the host computer 222.

When a transfer start switch (not shown) is turned ON, the photoconductive drum 34 is rotated in the clockwise direction of FIG. 24 by means of a drive means (not shown) to actuate the corona charger 35 to positively charge the photoconductive material 34A by corona discharge, which corresponds to the electric charging (FIG. 5A) in the first embodiment. In this case, in the corona charger 35, the discharge voltage is controlled by the host computer 222 in accordance with the photoconductive material characteristics (electric charging characteristic, dark decay characteristic) information stored within the memory 215 to correct the unevenness of the characteristics taken in the rotating direction of the photoconductive material 34A.

Next, the photoconductive material 34A is exposed by LED array 211. The light amount of this LED array 211 may be adjusted in accordance with the photoconductive material information (electric charging characteristic, dark decay characteristic) stored in the memory 215.

Thus, as shown in FIG. 25, in order to correct the unevenness of the surface potential as distributed in the axial direction of the photoconductive material 34 electrically charged by the corona charger 35, a light amount (E1) is illuminated from LED array 211 under control of the host computer 222 to unify the potential distribution as measured in the axial direction of the photoconductive material 34 (E2).

Incidentally, the potential distribution depicted in FIG. 26 corresponds to that of the photoconductive material 34 as measured in the axial direction thereof taking into account a potential reduction caused by the dark decay.

When the image forming portion of the photoconductive material, which is positively charged in a substantially uniform manner, is positioned at the exposure position, the laser beam illuminated from the semiconductor laser 12 is modulated according to the image information to thereby expose the photoconductive material 34A (corresponding to FIG. 5A).

In this case, the light intensity of the laser beam is modulated by the host computer 222 according to the light intensity characteristic information 223 stored in the memory 215. In consequence, by this modulation of this laser beam, the unevenness of the photosensitivity characteristic of the photoconductive material 34A can be corrected.

When the surface of the photoconductive material 34A is exposed, its portion illuminated by the laser beam is turned electrically conductive and the positive charges on the surface are shifted to form an electrostatic latent image corresponding to the image information.

The photoconductive material 34A, on the surface of which the latent image is formed, is further rotated in the clockwise direction of FIG. 24 to be uniformly applied with the carrier solution on its surface by the prewet unit 50.

The prewetted portion of the photoconductive material 34A is further rotated in the clockwise direction of FIG. 24 to reach a position corresponding to the developing agent unit 36. In this case, the developing agent unit 36 is previously disposed, in which a liquid developing agent which contains the black toner particles is stored. This developing agent unit 36 applies the liquid developing agent containing the black toners to the area where the electrostatic latent image is formed, via the developing roller 40 (corresponding to FIG. 5A). In this case, the bias voltage of the developing roller 40 is controlled by the host computer 222 connected to the developing bias voltage controller 40A according to the characteristic information (in particular, the dark decay characteristic) stored in the memory 215 to correct the unevenness of the residual potential taken in the rotating direction thereof.

As a result, the negatively charged toner particles within the developing agent will stick to the image portion for forming the latent image and the image is revealed while the unevenness of characteristics of the photoconductive material 34A portion, which corresponds to the image or non-image portion, is corrected to form a uniform and stable toner image (corresponding to FIG. 6A).

At the third rotation of the photoconductive material 34A, the light emitted from LED array 211 is supplied to the portion of the photoconductive material 34A, which is eliminated from electricity due to AC corona discharge by the corona charger 35 (corresponding to FIG. 5C, removal of electricity), to thereby remove the electric charges remaining thereto even after its removal (corresponding to FIG. 5C). Thereafter, the drying operation will be continued until the third rotation is completed.

At the time of the third rotation of the last color, the precharged portion of the photoconductive material 34A (corresponding to FIG. 51, precharging) is further rotated in the clockwise direction of FIG. 24 to reach the position corresponding to LED array 211. The light emitted by LED array 211 is supplied to the photoconductive material 34A for previous exposure.

Other operations are similar to those of the first embodiment, and their description is omitted.

In the above-described embodiment, although each photoconductive material characteristic information such as electric charging characteristic, dark decay characteristic and photosensitivity characteristic at each point of the photoconductive material 34A is stored in the memory 215, in addition data regarding the environmental conditions such as temperature, humidity or the like at each point of the photoconductive material 34A may be stored therein so that the image forming means such as the corona discharger 35 or the like may be controlled in accordance with that information. In that case, an even more uniform and stable image can be formed.

In addition, in the above-described embodiment, although LED array 211, multi AOM 18, corona charger 35 and the developing bias voltage controller 40A are controlled by the host computer 222 in accordance with the characteristic information about each point of the photoconductive material 34A, which is stored in the memory 215, alternatively, part of these may be controlled by the host computer 222 according to the characteristic information about each point of the photoconductive material 34A to correct the unevenness of the characteristic of the photoconductive material 34A so that a uniform and stable image may be formed.

Next, a fourth embodiment is hereinafter described using FIGS. 27–29.

This embodiment is similar to the above-described third embodiment, and in describing the same, like materials, portions and the like are designated with like reference numerals used in describing the first and third embodiments and a description of which is omitted.

An exposure portion 10, which forms part of the liquid electrophotographic apparatus, comprises a semiconductor laser 12, a controller portion 14 for controlling the output condition of the same 12, condenser lenses 16, 26, a scanner lens 28, reflecting mirrors 34, 30, a multi AOM (acoustic optical modulator) 18 connected to a buffer 19 for dividing the incident laser beam into a plural number laser beams according to the frequency of the incident ultrasonic, a polygon mirror 20 and a memory 15. The memory 15 records the image information supplied from a host computer 22, which serves as an arithmetic operation means as well as a means for controlling the amount of exposed light while storing a correction value of the charge voltage (described later) for correcting the dark decay characteristic of the photoconductive material 34A on the outer circumferential surface of the photoconductive drum 34 and a correction value of the amount of exposed light for correcting the light decay characteristic of the photoconductive material 34A.

In addition, the intensity of the laser beam is modulated in accordance with the correction value of the amount of the exposed light, which is stored in the memory 15 by the multi AOM 18. Consequently, the light decay characteristic of the photoconductive material 34A may be corrected.

Figure 27:
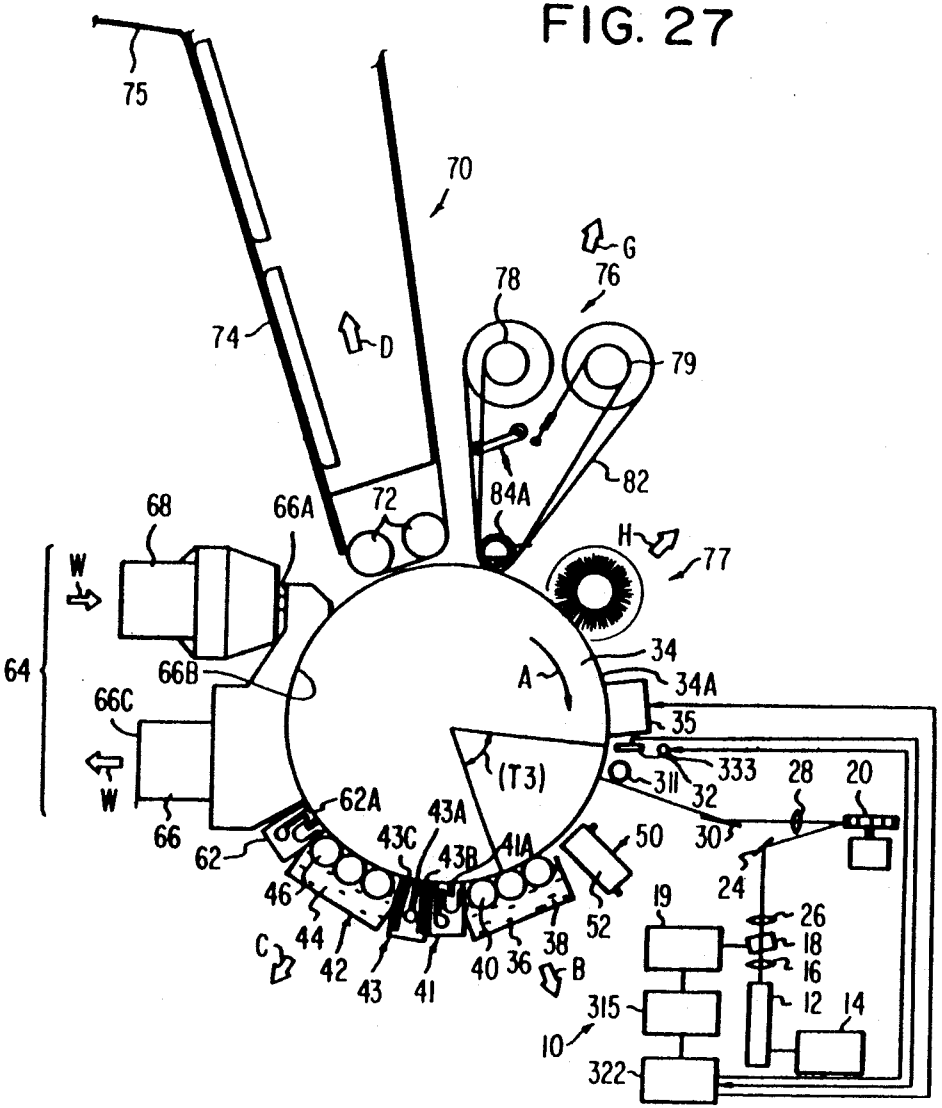
FIG. 27 is a layout view of each processing portion which forms an apparatus according to a fourth embodiment of the present invention.

The above-described photoconductive drum 34 is connected to a drive means (not shown), by means of which it is rotated in the clockwise direction of FIG. 27 (e.g., in the direction of arrow A of FIG. 27).

In addition, as in the third embodiment, the rotating angle of the photoconductive drum 34 (the position where the drum 34 is rotated from the home position) is sensed by a well known unit for sensing the rotating position of the drum to be each entered into the host computer 22.

Disposed upstream of the photoconductive material 34A, as viewed in the rotating direction thereof, where the laser beam is incident on the photoconductive material is a corona charger 35, which serves as a means for electrically charging the photoconductive material. This corona charger 35 is provided with a corona wire and a grid wire and is connected to AC ad DC power supplies via a switch (not shown). In addition, the corona charger 35 is connected to the host computer 322, which may control the discharging voltage in accordance with the correction value of the charge voltage stored in the memory 315.

Disposed downstream of the corona charger 35, as viewed in the rotation direction of the photoconductive drum 34 is a surface potential sensor 32, which serves as a means for sensing the surface potential, the surface potential sensor 32 allowing the surface potential of the photoconductive material to be sensed. In addition, the surface potential sensor 32 is connected to the host computer 322.

In addition, a lamp 333 as a light source is disposed at a position of the surface potential sensor 32 opposed to the point for measuring the surface potential off the photoconductive material 34A, which lies at the opposite side of the drum 34. This lamp 33 is connected to the host computer 322 so as to expose the point for measuring the surface potential of the photoconductive material 34A electrically charged by the corona charger 35 for a predetermined period of time.

In addition, after being exposed by the lamp 333, the measuring point of the photoconductive material 34A is stopped at the position facing the sensor 32, and thereafter the surface potential at the measuring point after it reaches the developing position is read into the host computer 322 to determine the surface potential at the time of development, which is caused by the light decay characteristic of the photoconductive material 34A to compare it with the target surface potential observed under light illumination during developing. As a result, a correction value is determined of the amount of exposed light required for correcting the light decay characteristic of the photoconductive material 34A for storage into the memory 315.

The portion of the photoconductive material 34A, where the laser beam is incident, is turned electrically conductive and the electric charges thereon disappear to form the electrostatic latent image on the surface thereof.

As shown in FIG. 27, disposed downstream of the surface potential sensor 32, as viewed in the rotating direction of the photoconductive drum 34 is an exposure lamp 311. By illuminating the light from this exposure lamp 311 onto the photoconductive material 34A, the electric charges on the photoconductive material 34A can be neutralized (removal of electricity by optical means). This removal of electricity by optical means may display a function similar to one by the above-described corona charger 35 while, as will be later described, performing the previous exposure in order to improve the transfer efficiency of toner adhering to the photoconductive material 34A.

Other arrangements are similar to the third embodiment, and their description is omitted.

The operation of this embodiment is hereinafter described.

In this embodiment, when the apparatus is started, or each time a predetermined time passes after the start, the correction values of the charge voltage and the amount of the exposed light are calculated to stored into the memory 315 in accordance with the following manner.

In accordance with a flowchart of FIG. 29, correction values are calculated to and stored in the memory 315 as described below.

First, the photoconductive drum 34 is rotated to completely eliminate the electricity on the photoconductive material 34A (step 400), and then a predefined measuring point on the photoconductive material 34A is electrically charged to a predetermined voltage by means of the corona charger 35 (step 402).

When this measuring point reaches a position opposed to the surface potential sensor 32, the photoconductive drum 34 is stopped to start detection of the surface potential at the measuring point by the surface potential sensor 32 (step 404).

Figure 28:
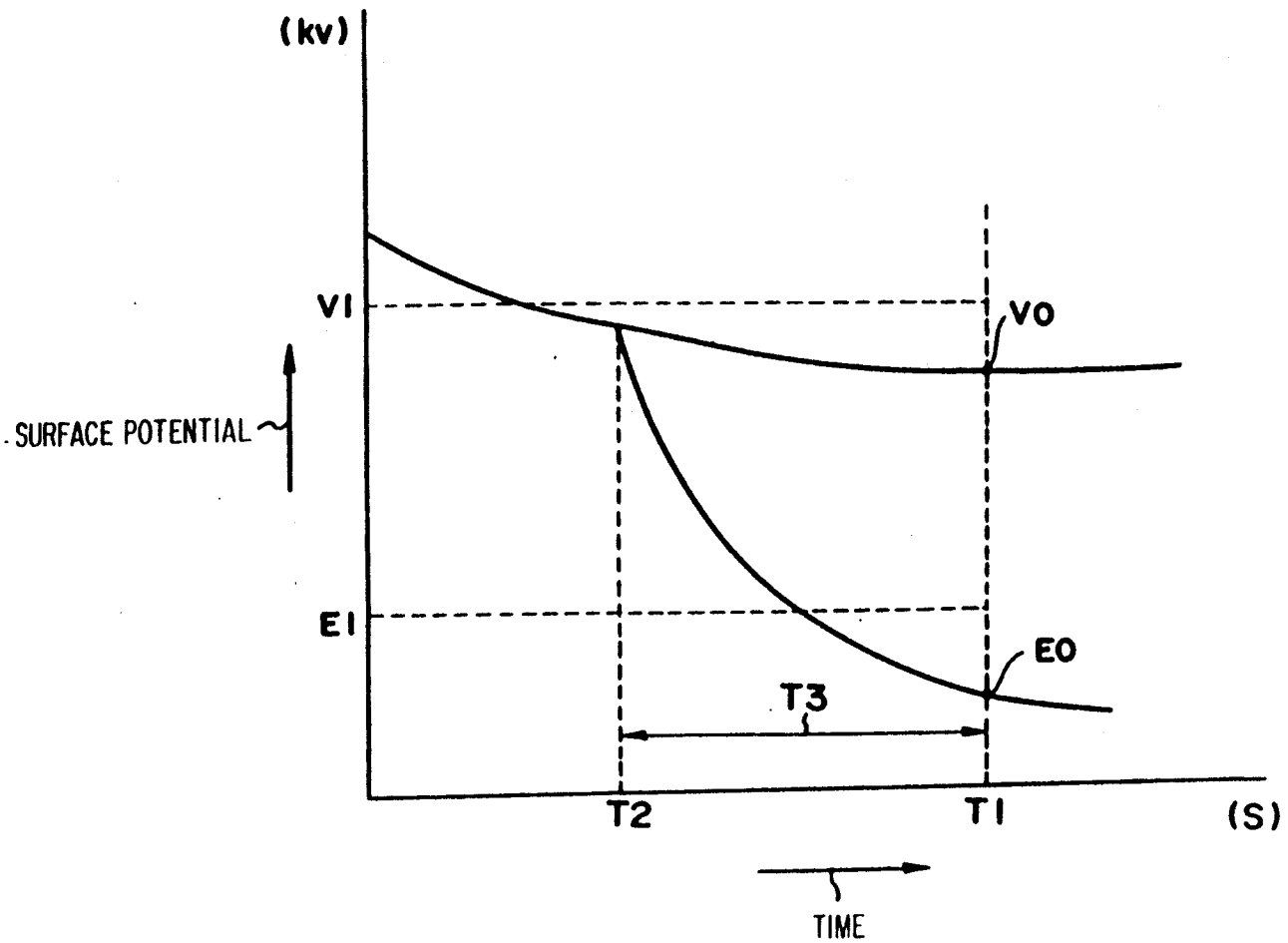
FIG. 28 is a graphic view illustrating the dark decay characteristic and light decay characteristic for the photosensitive material of the apparatus according to the fourth embodiment.
Figure 29:
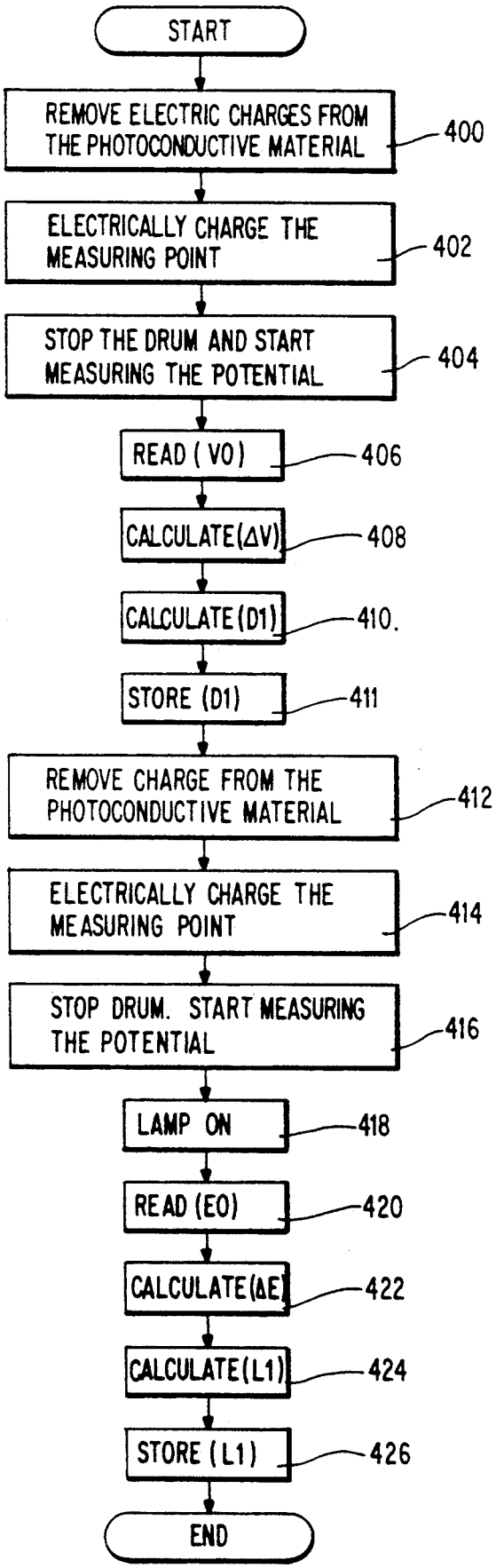
FIG. 29 is a flowchart illustrating a procedure for calculating the correction value of the apparatus according to the fourth embodiment and storing it into the memory.

As shown in FIG. 28, the surface potential (V0) at the measuring point after the time (T1) when it reaches the developing roller 40 is read into the host computer 322 (step 406).

A ratio of this surface potential (V0) with the target surface potential (V1) at the time of developing ($\Delta V = V1/V0$) is evaluated (step 408) and a correction voltage ($D1 = \Delta V \cdot D0$) of the charge voltage (D0) is calculated (step 410) to store onto the memory 315 (step 412).

Again, the photoconductive drum 34 is rotated to remove the electricity from the photoconductive material 34A (step 412).

Then, the predefined measuring point on the photoconductive material 34A is electrically charged at a predetermined voltage (step 414).

When the measuring point of this photoconductive material 34A reaches the point opposed to the surface potential sensor 32, the electric charging is stopped to stop the photoconductive drum 34 to start detection of the surface potential at the measuring point by the surface potential sensor 32 (step 416).

As shown in FIG. 28, after the time (T2) the measuring point reaches the position exposed by the exposure portion 10, the lamp 333 is turned ON to expose the measuring point for a predetermined period of time (step 418).

In addition, the surface potential (E0) at the measuring point after the time (T3) the measuring point reaches the developing position is read into the host computer 322 (step 420).

A ratio ($\Delta E = E1/E0$) to the target surface potential (E1) to the surface potential at the measuring point after time T(3) at the developing is evaluated (step 422) to calculate the correction value ($L1 = \Delta E \cdot DL$) (step 424) to store into the memory 15 (step 426).

The image forming processing is conducted in accordance with the correction value (D1) of the charge voltage stored in this memory 315 and the correction value (L1) of the amount of exposed light.

Figure 34:
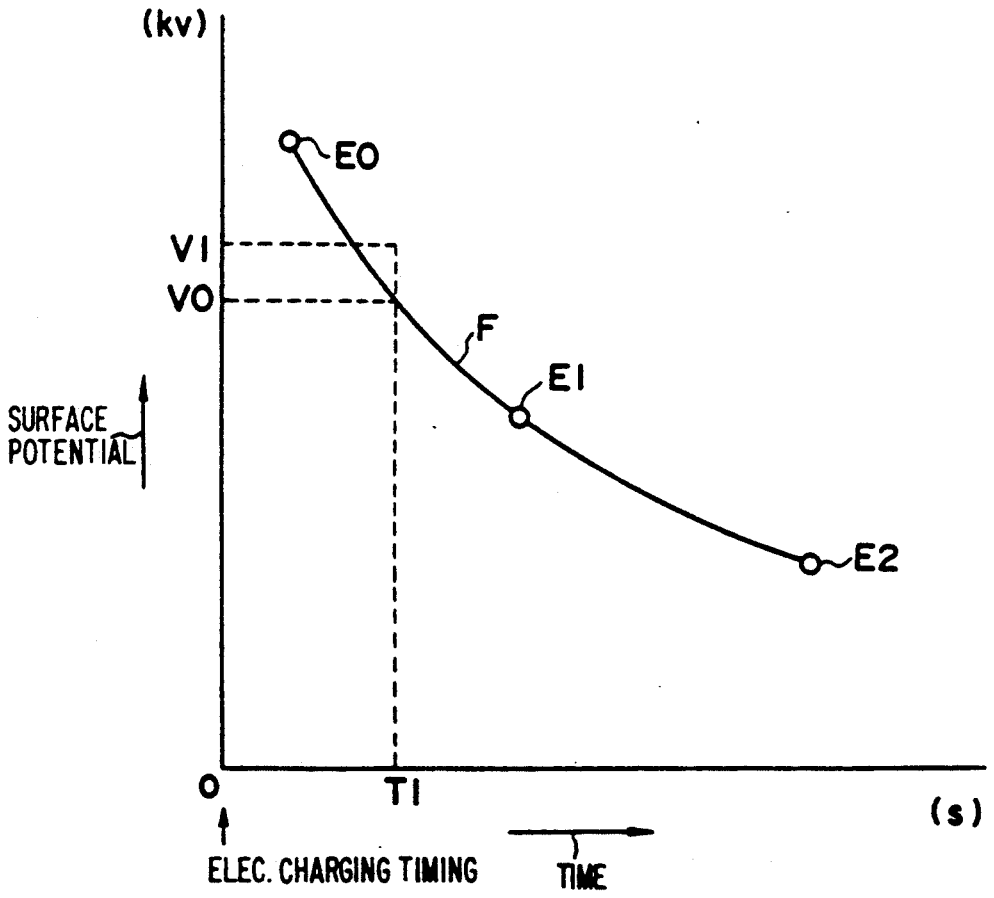
FIG. 34 is a graphic view illustrating the dark decay characteristic for a photoconductive material of the apparatus according to the sixth embodiment.

When the transfer start switch (not shown) is turned ON, the photoconductive drum 34 is rotated in the clockwise direction of FIG. 34 by a drive means (not shown) to actuate the corona charger 35, which causes DC corona discharge to positively charge the photoconductive material 34A (corresponding to FIG. 5A). In this case, the discharge voltage is controlled in accordance with the correction value (D1) of the charge voltage stored in the memory 315 by the host computer 322. As a result, it can be prevented with high accuracy that the surface potential of the photoconductive material 34A at the time of developing be lowered due to the dark decay characteristic.

When the image forming portion of the photoconductive material 34A, the surface of which is uniformly and positively charged, reaches the exposure position, the laser beam illuminated from the semiconductor laser 12 is modulated according to the image information to thereby expose the photoconductive material 34A (corresponding to FIG. 5A).

In this case, the amount of exposed laser beam is controlled in accordance with the correction value (L1) of the same stored in the memory 315 by the host computer 322. In consequence, it can be prevented with high accuracy that the surface potential of the photoconductive material 34A at the time of developing be lowered due to the dark decay characteristic. As a result, in the developing treatment, which will be later described, a stable image can be formed.

Supplied to the portion of the photoconductive material 34A where electricity is removed by the corona charger 35 (corresponding to FIG. 5C, removal of electricity) is the light emitted from the exposure lamp 11 to remove the electric charges the electric charges still remaining on the photoconductive material 34A thereafter (corresponding to FIG. 5C, removal of electricity). Thereafter, the drying operation is continued until the third rotation is completed.

In addition, the precharged portion of the photoconductive material 34A (corresponding to FIG. 5I, precharging) is further rotated in the clockwise direction of FIG. 27 to reach the position corresponding to the exposure lamp 311. The light emitted from the exposure lamp 311 is supplied to the photoconductive material 34A for previous exposure.

Next, a fifth embodiment of the invention is described with reference to FIGS. 30 to 32.

Incidentally, the same materials as used in the fourth embodiment are designated with the same reference numerals and their description is omitted.

Figure 30:
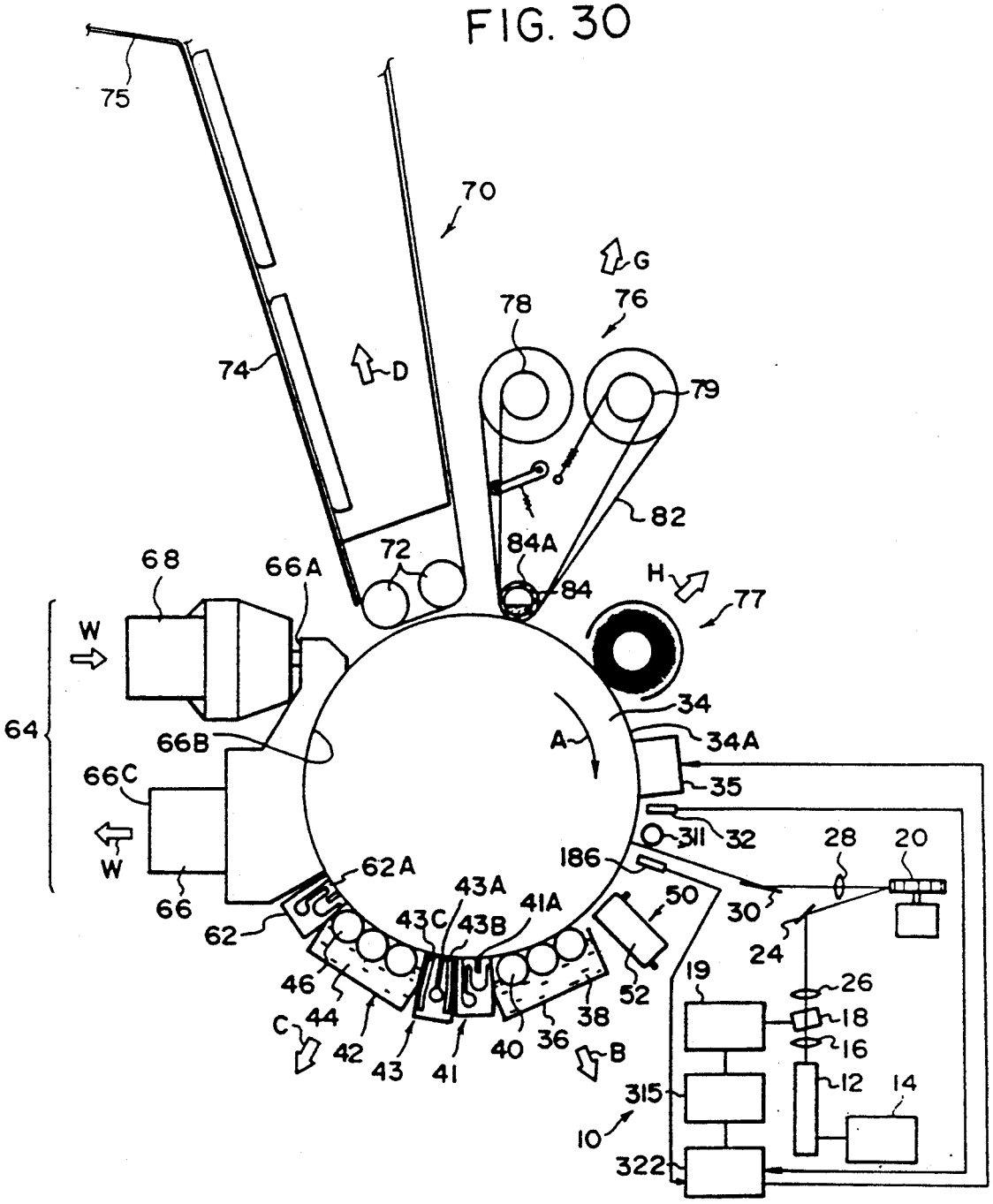
FIG. 30 is a layout view of each processing unit which forms an apparatus according to a fifth embodiment.

As shown in FIG. 30, in this embodiment, a surface potential sensor 186 as a means for sensing the surface potential is disposed downstream of the photoconductive drum, as viewed in the rotating direction thereof. This surface potential sensor 186, similarly to the sensor 32, is connected to the host computer 322. In addition, in this embodiment, an exposure lamp 311 also serves as a light source for evaluating the light decay characteristic of the photoconductive material 34A, and the lamp 333 of the fourth embodiment is omitted.

Figure 32:
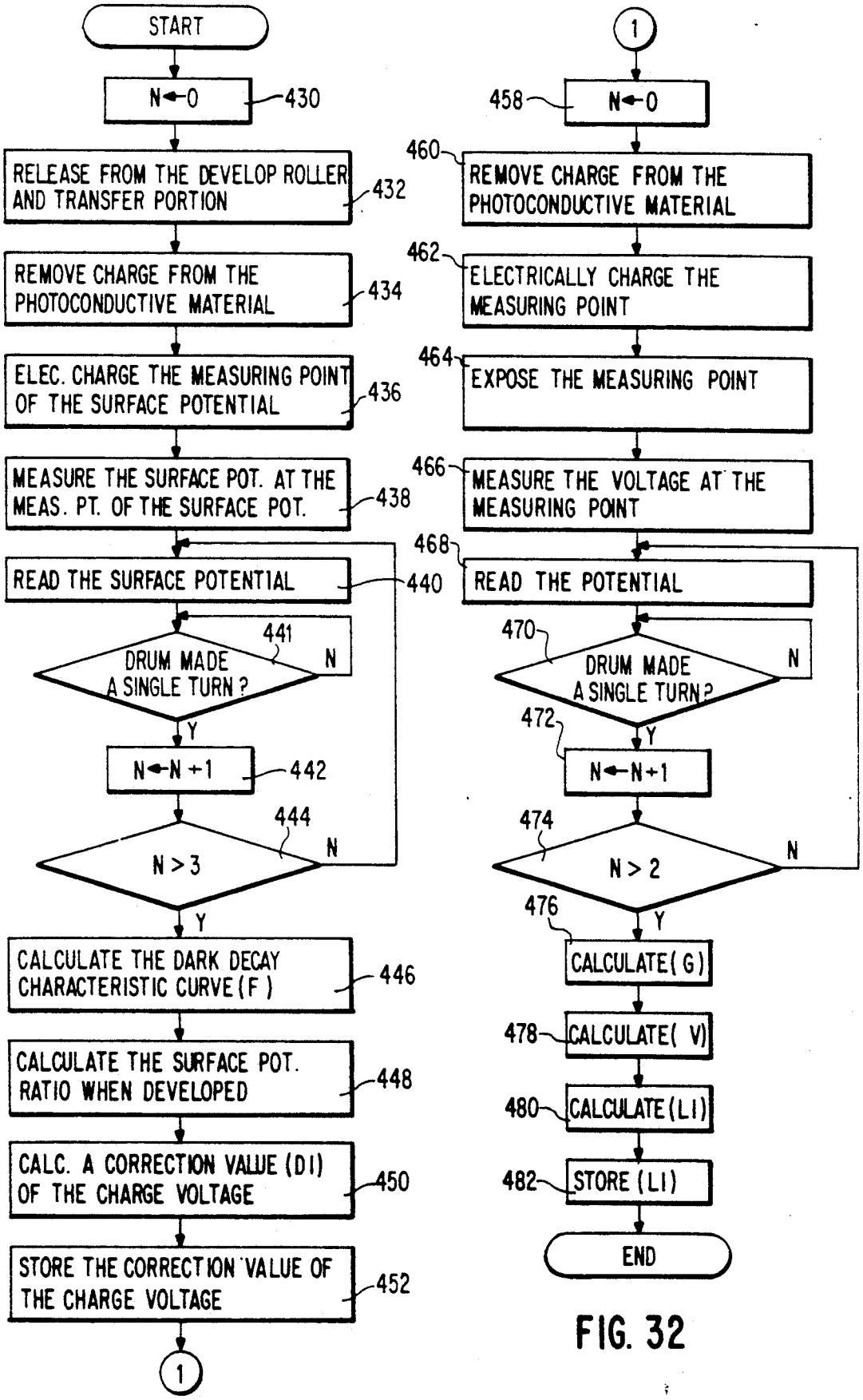
FIG. 32 is a flowchart illustrating a procedure for calculating the correction value for the apparatus and storing it into the memory according to the fifth embodiment.

Next, how the correction values of the charge voltage in this embodiment and the amount of exposed light are calculated, and a procedure for storing them into the memory 314 are described in accordance with the flowchart of FIG. 32.

Following treatments are performed as the apparatus is started or a predetermined time after the start of the same.

First, a counter N of the host computer 322 is cleared (step 430).

A developing roller 40, rinse roller 45, transfer portion 70, cleaning portion 76 and a cleaning brush 77 are respectively shifted in the direction of arrows B, C, D, G and H to disengage from the photoconductive drum 34 (step 432).

Next, the electric charges are completely removed from the photoconductive material 34A (step 434) and thereafter the photoconductive drum 34 is rotated to electrically charge the predefined measuring point on the photoconductive material 34A at a predetermined voltage by the corona charger 35 (step 436).

Figure 31A:
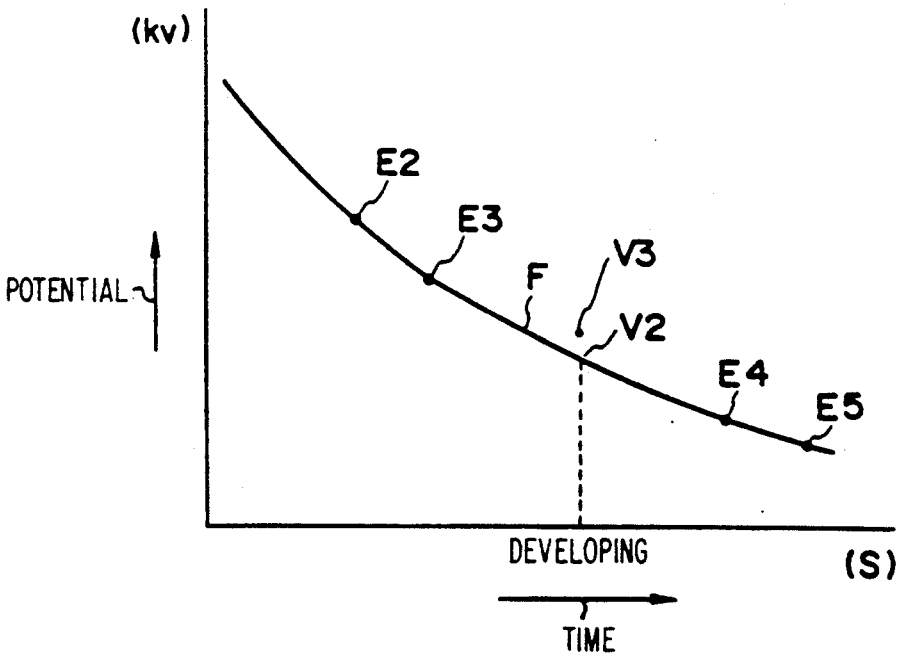
FIG. 31A and 31B are respectively a graphic view illustrating the dark decay characteristic and light decay characteristic for a photoconductive material of the apparatus according to the fifth embodiment.

The surface potential at the measuring point of this photoconductive material 34A is sensed by surface potential sensors 32, 186 (step 438) and the surface potentials (E3) at the measuring point immediately after electrically charged, which are shown in FIG. 31A, are read into the host computer 322 (step 440). Similarly, the surface potentials (E4, E5) at the measuring point after the drum 34 makes a turn are respectively read into the host computer 322 (steps 440, 441, 442 and 444).

The host computer 322 calculates a dark decay characteristic curve F of the photoconductive material 34A, as shown in FIG. 31A, from the above-mentioned four surface potentials (E2, E3, E4, E5) (step 446).

In addition, by this dark decay characteristic curve F, the surface potential (V2) at the time of developing is calculated, and a ratio of the calculated surface potential (V2) to the target surface potential (V3) at the time of developing ($\Delta V = V3/V2$) is evaluated (step 448) to calculate the correction value (D1) of the charge voltage (step 450) to store into the memory 315 (step 452).

Next, the counter N of the host computer 322 is cleared (step 452).

The electric charges on the photoconductive material 34A are completely removed (step 460) and then the photoconductive drum 34 is rotated to electrically charge the predefined measuring point on the photoconductive material 34A at a predetermined voltage by the corona charger 35 (step 462).

The exposure lamp 311 is lit for a predetermined time to expose the measuring point under a predetermined amount of light (step 464).

Figure 31B:
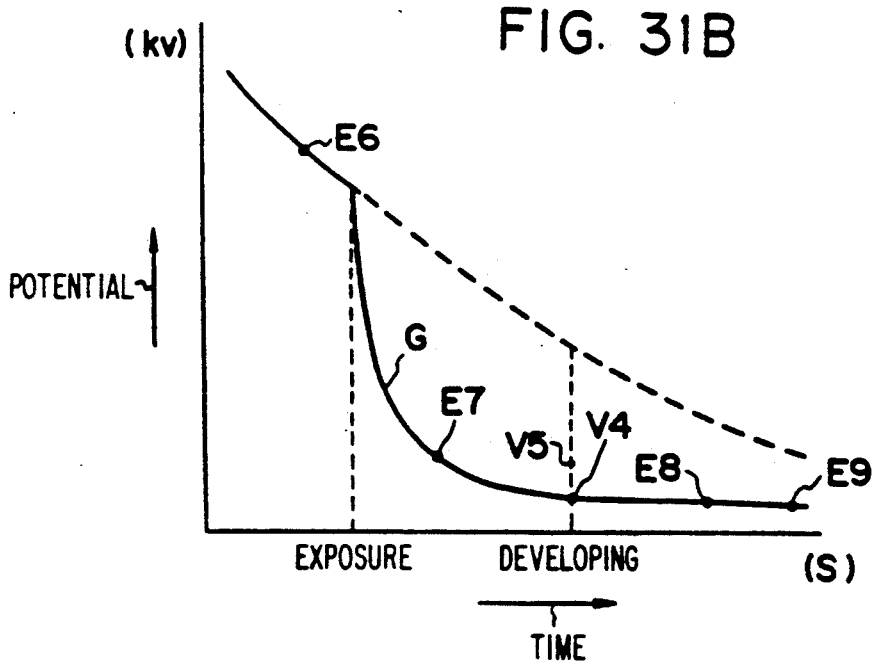

This surface potential at the measuring point of the photoconductive material 311 is sensed by surface potential sensors 32, 186 (step 466) and the surface potentials (E6, E7) at the measuring point immediately after electrically charged, as shown in FIG. 31B, are read into the host computer 322 (step 468). Similarly, the surface potentials (E8, E9) at the measuring point after the drum 34 makes a turn, are read into the host computer 322 (steps 468, 470, 472, 474).

The host computer 322 assigns the above-four point surface potentials (E6, E7, E8, E9) to a well known light decay characteristic curve function, for example, if the photoconductive material 34A is an amorphous selenium, then a function expressed by the following formula:

$$V = V_0 \exp\left[-A_1(1-e^{t})/\alpha) - A_2 t\right] \quad (1)$$

(where: $A_1$, $A_2$, $\alpha$ represent a constant and $V_0$ an initial amount of charge)

The four surface potentials (E6, E7, E8, E9) are substituted to thereby evaluate each constant $A_1$, $A_2$ and $\alpha$ to calculate the light decay characteristic curve G of the photoconductive material 34A as shown in FIG. 31B (step 476).

In addition, from this light decay characteristic curve GA, the surface potential (V4) at the time of developing is calculated and a ratio of the calculated surface potential (V4) to the target surface potential at the developing time (V5) ($\Delta V = V5/V4$) (step 476) to calculate the correction value for the amount of exposed light (L1) (step 480) for storage into the memory 315 (step 482).

In accordance with the correction value (D1) of the charge voltage stored into this memory 315 and the correction value (L1) of the amount of exposed light, the host computer 322 controls the corona charger 35 and multi AOM 18 to conduct an image processing, as in the fourth embodiment.

In addition, as described above, in the above-described fifth embodiment, when the apparatus is started or every predetermined time after the its start, the correction values for the charge voltage and the amount of exposed light are calculated in accordance with the above-described method to tore into the memory 315. Alternatively, they may be similarly calculated while the photoconductive drum 34 is idly rotated for drying purposes after developing to store into the memory 315.

In addition, in the above-described fifth embodiment, two surface potential sensors 32, 186 are disposed downstream of the drum 34 as viewed in the rotating direction thereof. Alternatively, either one or three or more sensors 32 may be disposed at positions opposed to the photoconductive material 34A so that as the surface potential measuring point (P) reaches the positions opposed to each sensor the surface potentials there may be respectively read into the host computer 322.

Next, a sixth embodiment is described with reference to FIGS. 33-36.

This embodiment is similar to the fourth and fifth embodiments, and in describing this embodiment, like materials, parts and the like as used in those embodiments are designated with like reference numerals their description is omitted.

An exposure portion 10, which forms part of the liquid electrophotographic apparatus, comprises a semiconductor laser 12, a controller portion 14 for controlling the output condition of this semiconductor laser 12, condenser lenses 16, 26, a scanner lens 28, reflecting mirrors 24, 30, a multi AOM 18 (acoustic optical modulator) connected to a buffer 19 for dividing the incident laser beam into a plurality of components according to the frequency of the incident ultrasonic, a polygon mirror 20, a memory 515 for recording the image information supplied from a host computer 522 as an arithmetic operation means and a means for controlling the charge voltage while also serving as a memory means for storing the correction value of the charge voltage, which corrects the dark decay characteristic of the photoconductive material 34A on the outer circumferential surface of the photoconductive drum 34 (described later).

Disposed downstream of the corona charger 34, as viewed in the rotating direction of the photoconductive drum 34 is a surface potential sensor 32 as a means for sensing the surface potential so that the surface potential of the photoconductive material 34A on the outer circumferential surface of the drum 34 may be sensed. In addition, the sensor 32 is connected to the host computer 522, which extracts three different surface potentials of the same measuring point assumed at zero rotation and after. After the first and second rotations of the photoconductive material 34A from values sensed by the surface potential sensor 32 the host computer 522 calculates a dark decay characteristic curve of the same while calculating a surface potential to be assumed at the developing operation to compare the calculated value assumed at developing with the target surface potential value, to thereby evaluate a correction value of the charge voltage for storage into the memory 515.

Other arrangements are similar to those of the fourth and fifth embodiments, and their description is omitted.

The operation of this invention is hereinafter described.

Figure 33:
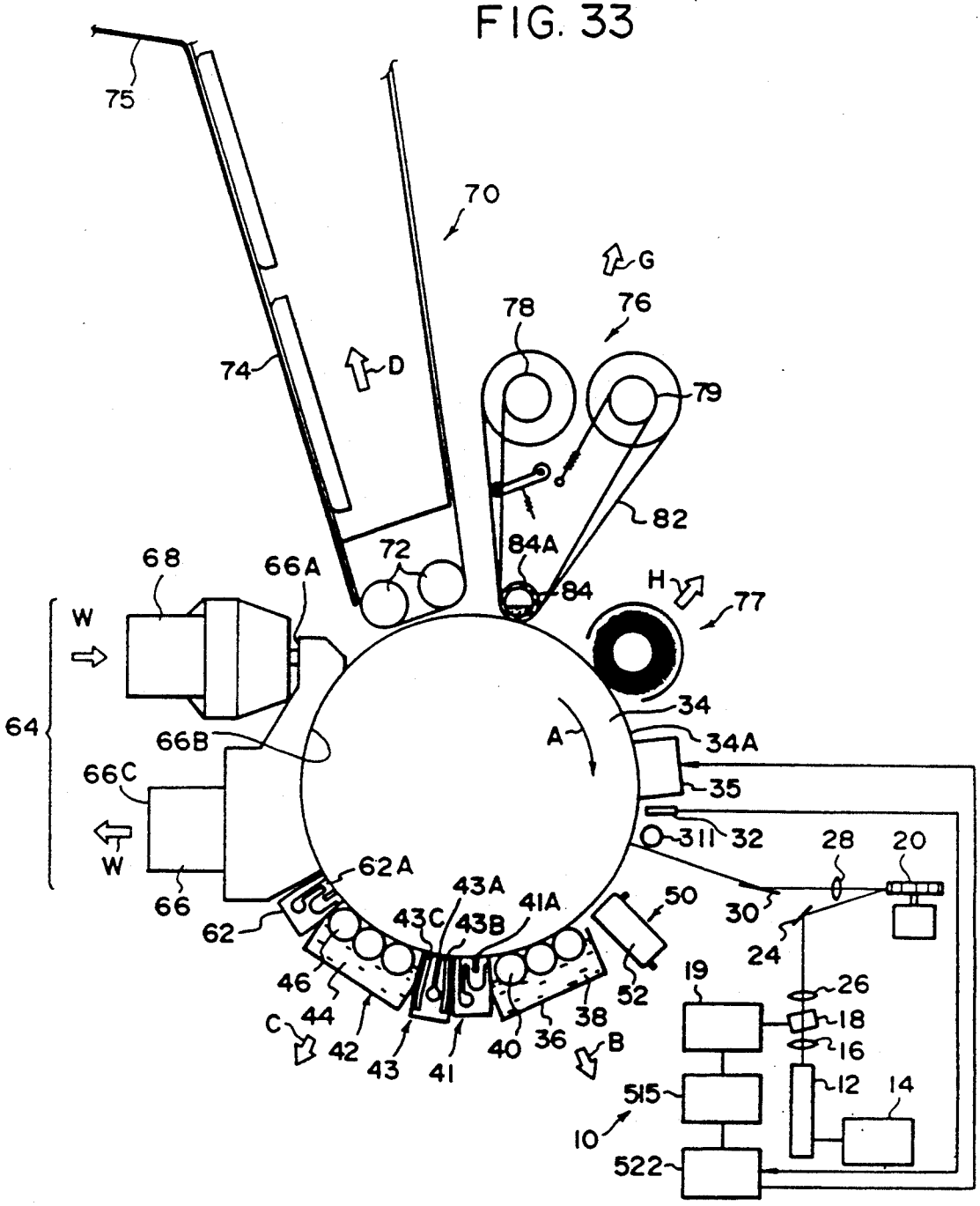
FIG. 33 is a layout view of each processing unit which forms an apparatus according to a sixth embodiment of the present invention.

In this embodiment, a non-image forming area as shown in FIG. 33 is previously provided on the photoconductive drum 34 so that in the image forming treatments which follow a surface potential, which serves as correction data for the subsequent electric charging, may be measured.

By turning ON a start switch (not shown), or in accordance with a start signal fed from the exterior, a process sequence for the first rotation of the first color is started and the photoconductive drum 34 is rotated in the clockwise direction of FIG. 33 by means of a drive means (not shown) to actuate the corona charger 35 to positively charge the photoconductive material 34A by corona discharge (corresponding to FIG. 5A). In this case, the discharge voltage for the corona charger 35 is controlled in accordance with the correction value (D1) of the charge voltage stored in the memory 515 by the host computer 522, as will be described later. Consequently, it can be corrected with high accuracy such that the surface potential of the photoconductive material 34A can be lowered during development with the result that a stable image can be formed at the developing step which will be later described.

The surface potential at the measuring point of this photoconductive material 34A is sensed by the surface potential sensor 32 and a surface potential (E0) at the measuring point immediately after the photoconductive material is electrically charged, as shown in FIG. 34, is read into the host computer 22.

Incidentally, the non-image area for measuring the surface potential is not exposed and stays electrically charged.

The photoconductive material 34A having an electrostatic latent image formed on its surface is further rotated in the clockwise direction of FIG. 33 to be uniformly applied with a carrier solution on its surface by a prewet unit 50.

In addition, during this first rotation, the non-image forming portion formed at the photoconductive material 34A shifts the developing roller 40, rinse roller 46, transfer portion 70, cleaning portion 76 and the cleaning brush 77, respectively in the directions of arrows B, C, D, G and H as it passes through along each process of the developing, rinsing, transferring, and cleaning, to disengage them from the photoconductive drum 34.

By the drying operation conducted at the second rotation of the first color, the rinse solution and the carrier solution which exist between the toner particles, which form the electrostatic latent image, are evaporated to enhance an interaction (binding force) between them.

At this second rotation, when the non-image forming area comes under the sensor 32, as in the first rotation, the surface potential (E1) at the measuring point after the drum 34 makes a turn is read into the host computer 522.

In addition, at the third rotation of the first color, when the non-image forming area comes under the sensor 32, the surface potential (E2) at the measuring point after the drum 34 is rotated twice is read into the host computer 522.

the host computer 522 calculates a dark decay characteristic curve F of the photoconductive material 34A, as shown in FIG. 34, from the above-described three point surface potentials (E0, E1, E3).

In addition, from this dark decay characteristic curve F, the surface potential (V0) assumed after the developing time (T1) passed is calculated to evaluate the ratio ($\Delta V = V1/V2$) of the calculated value (V1) to the target value (V2) at the time of developing to calculate the correction value ($D1 = \Delta V \cdot D0$) of the charge voltage (D0) for storage into the memory.

The second electric charging is conducted in accordance with the correction value (D1) of the charge voltage stored into the memory 515 from the data measured for the first color.

Other operations are similar to those in the fifth and sixth embodiments, and their description is omitted.

Incidentally, in the above-described embodiment, when the apparatus is started or every predetermined time after its start, the correction value of the charge voltage is calculated in the above-described manner. Alternatively, while the photoconductive drum 34 is idly rotated for the drying operation after developing, the same may be calculated to store into the memory 515. In this case, as shown in FIGS. 35 and 36, the measuring point (P) for the surface potential of the photoconductive material 34A is to be set to the non-image portion 34B of the same (slanting line portion of FIGS. 35 and 36).

In addition, in the above-described embodiment, although one surface potential 32 is disposed downstream of the corona charger 35 as viewed in the rotating direction of the photoconductive drum 34, alternatively, it may be disposed in plural number at different positions opposed to the photoconductive material 34A so that as the measuring point (P) reaches the position opposite to each sensor 32 the surface potentials there may be read into the host computer 522.

Figure 35:
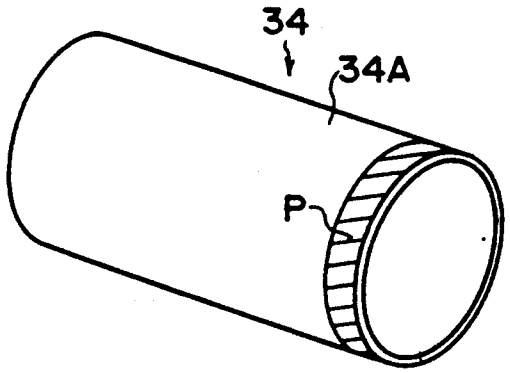
FIGS. 35 and 36 are respectively a perspective view illustrating a range of a non-image forming area provided in order to measure the surface potential of the photoconductive material of the apparatus according to the sixth embodiment.
Figure 36:
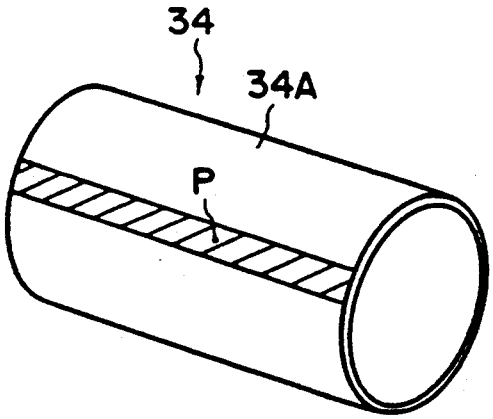

Finally, a similar effect might be achieved even if the non-image forming area is formed to take the form shown in FIG. 35, or one shown in FIG. 36, so that the developing roller 40, rinse roller 46, transfer portion 70, cleaning portion 76 and the cleaning brush 77 do not come in press contact with each other.

What is claimed is:

1. A liquid electrophotographic apparatus for forming a color image by transferring at one time a plurality of toner images of respective colors formed by being successively layered on a photoconductive material, said apparatus comprising:

a drum-shaped photoconductive material rotatable in a predetermined direction a predetermined number of times each time each toner image is formed and sensitive to light in a specific wavelength region, said photoconductive material being resistant to deterioration caused by a developing solution which has a predetermined light absorption factor in said specific wavelength region;

means for electrically charging said photoconductive material during a first rotation of said photoconductive material for each toner image of each color formed;

exposure means for illuminating the light in said specific wavelength region onto said photoconductive material having been electrically charged so that an electrostatic latent image is formed on said photoconductive material during a first rotation of said photoconductive material for each toner image of each color formed;

means for developing said electrostatic latent image by said developing solution during a first rotation of said photoconductive material for each toner image of each color formed;

means for drying said toner image formed on said photoconductive material by said developing means during the first and second rotations of said photoconductive material for each toner image of each color formed;

means for removing electricity from said photoconductive material during a third rotation of said photoconductive material for each toner image of each color formed except when a last toner image is being formed; means for simultaneously transferring said plurality of color toner images, formed on said photoconductive material, onto a transfer material; and first cleaning means for removing any toner particles remaining on a surface of said photoconductive material after transfer of said toner images by said transfer means.

2. A liquid electrophotographic apparatus as defined in claim 1, further comprising second cleaning means for cleaning a surface of said photoconductive material after the electricity is removed by said electricity removing means.

3. A liquid electrophotographic apparatus as defined in claim 2, wherein said first cleaning means comprises means for supplying a solvent onto the surface of said photoconductive material, said solvent being for dissolving said toner particles on said photoconductive material, and said first cleaning means further comprises means for removing the toner particles dissolved by said solvent from the surface of said photoconductive material, said second cleaning means comprising a fur brush embedded with soft fiber.

4. A liquid electrophotographic apparatus as defined in claim 3, wherein said solvent comprises a material which is the same as that of the carrier solution contained in the developing solution, said removing means being spaced apart from said photoconductive material and comprising a non-woven fabric which is selectively slidable into and out of contact with the surface of said photoconductive material.

5. A liquid electrophotographic apparatus as defined in claim 2, further comprising prewetting means for applying the carrier solution to said photoconductive material before each toner image is formed by said developing means and before said transfer of said each toner image by the transfer means.

6. A liquid electrophotographic apparatus as defined in claim 5, wherein said prewetting means is positioned to apply said carrier solution without contacting the surface of said photoconductive material.

7. A liquid electrophotographic apparatus as defined in claim 1, wherein said liquid solution comprises a rinse solution, and wherein said cleaning means comprises a plurality of rinse rollers and means for preventing toner from adhering to a background portion of an image being formed.

8. A liquid electrophotographic apparatus as defined in claim 1, comprising memory means for storing characteristic information about the photoconductive material to include at least one of an electrical charging characteristic, a dark decay characteristic, and a light decay characteristic, and adjusting means for correcting at least one of a surface potential on said photoconductive material, an amount of light to be illuminated onto said photoconductive material, an amount of light to be illuminated onto said photoconductive material by said exposure means and a developing bias voltage applied at a time of developing in accordance with said characteristic information stored in said memory means to adjust an amount of toner to be applied to said photoconductive material.

9. A liquid electrophotographic apparatus as defined in claim 2, further comprising:

first timing determining means for actuating said electrically charging means at a predetermined timing to electrically charge the surface of said photoconductive material, second timing means for actuating said exposure means at a predetermined timing to expose the surface of said photoconductive material, means for sensing a surface potential of said photoconductive material, means for allowing said surface potential sensing means to sense a predetermined position on the surface of said photoconductive material electrically charged based on an output of said first timing determining means and said electrically charging means, and a surface potential at said predetermined position of the photoconductive material exposed based on an output of said second timing determining means by said exposure means to read a value of said surface potential to determine the surface potential at said predetermined position at a time of developing, and for comparing the surface potential determined and the target surface potential at the time of developing to determine a correction value for the amount of exposed light, memory means for storing a correction value for said amount of exposed light, which is determined by said determining means, and means for controlling the amount of exposed light for the exposure means prior to formation of the toner image by said developing means in accordance with said correction value for the amount of exposed light, which is stored in said memory means.

10. A liquid electrophotographic apparatus as defined in claim 1, further comprising:

timing determining means for actuating said electrically charging means at a predetermined timing to electrically charge the surface of said photoconductive material, surface potential sensor means for sensing the surface potential of said photoconductive material, correction value determining means for extracting a plurality of surface potential values at a same position of a surface of said photoconductive material from a surface potential of said photoconductive material, which is sensed by said surface potential sensor means to calculate a dark decay characteristic curve of the surface of said photoconductive material while calculating the surface potential at a time of developing from said calculated curve to compare the calculated surface potential at the time of developing with a target surface potential at the time of developing to determine a correction value for a charge voltage for electrically charging said photoconductive material by said electrically charging means, which is conducted prior to exposure of said photoconductive material, memory means for storing a correction value determined by said correction value determining means, and means for controlling the charge voltage of said photoconductive material charged by said charging means, which is conducted prior to formation of the toner image by said developing means in accordance with said correction value stored in said memory means.

11. A liquid electrophotographic apparatus, comprising:

a drum-shaped photoconductive material axially rotating in a predetermined direction and sensitive to light in a specific wavelength region, said photoconductive material contacting and being resistant to deterioration caused by a developing solution containing toner particles and a carrier solution, said photoconductive material having a predetermined light absorption factor in said specific wavelength region;

means for electrically charging said photoconductive material;

exposure means for illuminating light in said specific wavelength region onto said photoconductive material having been electrically charged to form an electrostatic image on said photoconductive material;

developing means for developing said electrostatic image by said developing solution to sequentially form a plurality of color images on said photoconductive material in a deposited form;

drying means for drying said toner images each time said toner images are formed on said photoconductive material by said developing means; means for removing electricity from said photoconductive material each time said toner images are dried by said drying means prior to a last drying operation conducted after a last toner image is formed;

transfer means for transferring said plurality of color toner images formed on said photoconductive material simultaneously onto a transfer material; and first cleaning means for removing any toner particles still remaining on a surface of said photoconductive material after transfer of said color toner images by said transfer means, wherein said transfer means comprises an electrically conductive transfer roller selectively movable to abut and retract from said photoconductive material while being supplied with a voltage, an insulating sheet having an opening portion formed to make said transfer material directly contact said transfer roller, retaining means for holding said transfer material being provided at a peripheral portion of said opening portion, said insulating sheet being disposed between said photoconductive material and said transfer material, and shift means for shifting said insulating sheet so that said transfer material retained by said insulating sheet is selectively movable along an outer circumferential surface of said photoconductive material.

* * * * *